US011386857B2

(12) United States Patent
Saito et al.

(10) Patent No.: US 11,386,857 B2
(45) Date of Patent: Jul. 12, 2022

(54) DISPLAY DEVICE INCLUDING A PLURALITY OF IMAGE ADJUSTMENT CIRCUITS

(71) Applicant: Mitsubishi Electric Corporation, Tokyo (JP)

(72) Inventors: Yoshiya Saito, Tokyo (JP); Akinobu Nakamura, Tokyo (JP)

(73) Assignee: Trivale Technologies, Santa Clara, CA (US)

( * ) Notice: Subject to any disclaimer, the term of this patent is extended or adjusted under 35 U.S.C. 154(b) by 10 days.

(21) Appl. No.: 16/841,184

(22) Filed: Apr. 6, 2020

(65) Prior Publication Data

US 2020/0342821 A1 Oct. 29, 2020

(30) Foreign Application Priority Data

Apr. 24, 2019 (JP) ..... JP2019-082566

(51) Int. Cl.
*G09G 3/34* (2006.01)
*G09G 3/36* (2006.01)

(52) U.S. Cl.
CPC ..... *G09G 3/3413* (2013.01); *G09G 3/3648* (2013.01); *G09G 2320/066* (2013.01); *G09G 2320/0626* (2013.01); *G09G 2320/0673* (2013.01)

(58) Field of Classification Search
CPC .. G09G 3/3607; G09G 3/3648; G09G 3/2096; G09G 3/3413; G09G 2330/021; G09G 2320/0666; G09G 2310/027; G09G 2300/0447; G09G 2320/066; G09G 2320/0626; G09G 2320/0673
See application file for complete search history.

(56) References Cited

U.S. PATENT DOCUMENTS

| | | | | |
|---|---|---|---|---|
| 6,937,216 | B1 | 8/2005 | Ishiyama | |
| 7,098,901 | B2 | 8/2006 | Nakano et al. | |
| 7,113,180 | B2 | 9/2006 | Nakano et al. | |
| 8,583,999 | B2 | 11/2013 | Morino et al. | |
| 9,165,532 | B2 | 10/2015 | Ijima | |
| 9,171,512 | B2 | 10/2015 | Ijima | |
| 9,601,065 | B2 | 3/2017 | Kondo et al. | |
| 10,249,232 | B2 | 4/2019 | Kondo et al. | |
| 2010/0110094 | A1* | 5/2010 | Kamibayashi | H04N 13/324 345/589 |
| 2011/0162068 | A1* | 6/2011 | Abe | G06K 9/036 726/19 |

(Continued)

FOREIGN PATENT DOCUMENTS

| | | | |
|---|---|---|---|
| JP | 2001-092424 | A | 4/2001 |
| JP | 2002-108311 | A | 4/2002 |

(Continued)

*Primary Examiner* — Kwang-Su Yang
(74) *Attorney, Agent, or Firm* — Studebaker & Brackett PC

(57) ABSTRACT

A display device performs a comparison process of comparing first adjusted image data and second adjusted image data. The first adjusted image data is adjusted image data obtained by a first image adjustment element performing an image adjustment process on image data to be processed. The second adjusted image data is adjusted image data obtained by a second image adjustment element performing the image adjustment process on the image data to be processed.

12 Claims, 15 Drawing Sheets

(56) References Cited

U.S. PATENT DOCUMENTS

| | | | | |
|---|---|---|---|---|
| 2013/0342583 | A1* | 12/2013 | Kim | G06F 3/0412<br>345/690 |
| 2018/0124364 | A1* | 5/2018 | Yata | H04N 9/3179 |
| 2019/0080464 | A1* | 3/2019 | Lee | H04N 13/271 |

FOREIGN PATENT DOCUMENTS

| | | | |
|---|---|---|---|
| JP | 2006-005411 | A | 1/2006 |
| JP | 2009-128532 | A | 6/2009 |
| JP | 2010-190932 | A | 9/2010 |
| JP | 2014-085614 | A | 5/2014 |
| JP | 2014-085630 | A | 5/2014 |
| JP | 2014-228715 | A | 12/2014 |
| JP | 5670117 | B2 | 2/2015 |

* cited by examiner

DISPLAY DEVICE INCLUDING A PLURALITY OF IMAGE ADJUSTMENT CIRCUITS

BACKGROUND OF THE INVENTION

Field of the Invention

The present invention relates to a display device to adjust image data.

Description of the Background Art

A liquid crystal display typically includes a liquid crystal panel, a circuit board, and a flexible printed circuit (FPC). The FPC is a member to connect the liquid crystal panel and the circuit board.

The liquid crystal panel includes a pixel region, a gate driver integrated circuit (IC), and a source driver IC (hereinafter, also referred to as an "S-IC"). The gate driver IC is disposed in a peripheral region of the pixel region along a vertical axis. The source driver IC is disposed in the peripheral region of the pixel region along a horizontal axis. The gate driver IC performs ON/OFF control of a thin film transistor (TFT) of a pixel.

The circuit board includes a timing controller (hereinafter, also referred to as a "TCON"), ROM, an interface connector, a power supply circuit, and a tone reference voltage generation circuit. A set value is stored in the ROM. The TCON performs an image adjustment process on received image data. The image adjustment process includes a contrast adjustment process, a brightness adjustment process, and a gamma adjustment process. In some cases, the TCON outputs data after adjustment to a source driver.

The liquid crystal display is used not only for TV or PC displays, mobile phones, and the like but also for in-vehicle equipment, industrial equipment, and the like. Safety-related standards, such as ISO 26262 and IEC 61508, are set for the in-vehicle equipment, the industrial equipment, and the like. When the liquid crystal display is used for these products, the liquid crystal display also needs to meet requirements for safety.

When the liquid crystal display is used in place of a mirror as the in-vehicle equipment, for example, it is necessary to avoid the occurrence of an afterimage in an image displayed by the liquid crystal display. In the liquid crystal display, it is necessary to monitor the source driver IC and the gate driver IC to drive liquid crystals, a timing controller IC, and the like to check whether they operate without any problems.

In the display device, such as the liquid crystal display, a cyclic redundancy check (CRC) is performed to check that there is no anomaly in image data to be displayed. Japanese Patent No. 5670117 discloses a configuration (hereinafter, also referred to as a "related configuration A") in which the CRC is used to check whether image data to be displayed is normal.

In the related configuration A, the CRC is performed on image data before an image adjustment process (e.g., image quality adjustment). Thus, whether the image adjustment process has normally been performed on the image data cannot be checked in the related configuration A. That is to say, the related configuration A has a problem in that an image adjustment process having not normally been performed on the image data cannot be detected.

SUMMARY

It is an object of the present invention to provide a display device capable of detecting an image adjustment process having not normally been performed.

A display device according to one aspect of the present invention includes a plurality of image adjustment elements to perform an image adjustment process of adjusting image data, wherein each of the image adjustment elements performs the image adjustment process on the image data to be processed to obtain adjusted image data as the image data after adjustment, the plurality of image adjustment elements include a first image adjustment element and a second image adjustment element, and the display device performs a comparison process of comparing first adjusted image data as the adjusted image data obtained by the first image adjustment element performing the image adjustment process and second adjusted image data as the adjusted image data obtained by the second image adjustment element performing the image adjustment process.

According to the present invention, each of the image adjustment elements performs the image adjustment process on the image data to be processed to obtain the adjusted image data as the image data after adjustment.

The display device performs the comparison process of comparing the first adjusted image data and the second adjusted image data. The first adjusted image data is the adjusted image data obtained by the first image adjustment element performing the image adjustment process on the image data to be processed. The second adjusted image data is the adjusted image data obtained by the second image adjustment element performing the image adjustment process on the image data to be processed.

When the image adjustment process is normally performed by both the first image adjustment element and the second image adjustment element, the first adjusted image data and the second adjusted image data match. On the other hand, when the image adjustment process is not normally performed by the first image adjustment element and/or the second image adjustment element, the first adjusted image data and the second adjusted image data do not match.

The display device can thus detect the image adjustment process having not normally been performed by performing the comparison process.

These and other objects, features, aspects and advantages of the present invention will become more apparent from the following detailed description of the present invention when taken in conjunction with the accompanying drawings.

DESCRIPTION OF THE PREFERRED EMBODIMENT

Figure 1:
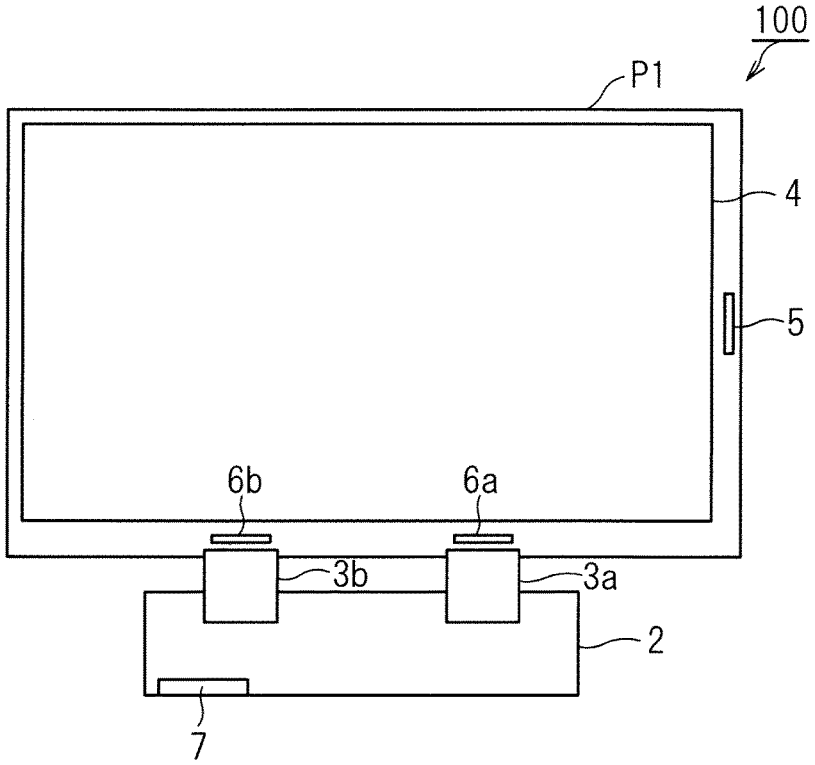
FIG. 1 schematically illustrates a configuration of a display device according to Embodiment 1.

An embodiment will be described below with reference to the drawings. The same components bear the same reference signs in the drawings below. Components bearing the same reference signs have the same names and functions. Detailed description of some of the components bearing the same reference signs will thus be omitted in some cases.

Embodiment 1

A display device relating to the present embodiment will be described below. FIG. 1 schematically illustrates a configuration of a display device 100 according to Embodiment 1. The display device 100 is, for example, a liquid crystal display. The display device 100 is not limited to the liquid crystal display. The display device 100 may, for example, be an organic electro-luminescence (EL) display.

Referring to FIG. 1, the display device 100 includes a display panel P1, a circuit board 2, and FPCs 3*a* and 3*b*. The FPCs are abbreviated names for flexible printed circuits. The display panel P1 is, for example, a liquid crystal panel. The FPCs 3*a* and 3*b* are arranged in parallel. The FPCs 3*a* and 3*b* connect the display panel P1 and the circuit board 2. The circuit board 2 and the FPCs 3*a* and 3*b* may be configured as a single FPC. In this configuration, the circuit board 2 is configured by a FPC.

The display panel P1 includes a pixel region 4, a gate driver IC 5, and source driver ICs 6*a* and 6*b*. The pixel region 4 is a region to display images. The display panel P1 displays images in the pixel region 4. The gate driver IC 5 is disposed in a peripheral region of the pixel region 4 along a vertical axis. The source driver ICs 6*a* and 6*b* are arranged in the peripheral region of the pixel region 4 along a horizontal axis.

The source driver ICs are hereinafter also referred to as "S-ICs". Each of the source driver ICs 6*a* and 6*b* has both a source drive function and a timing controller (TCON) function. That is to say, each of the source driver ICs 6*a* and 6*b* is an IC having integrated source drive and TCON functions. Each of the source driver ICs 6*a* and 6*b* includes a power supply circuit, memory, and the like. The gate driver IC 5 performs ON/OFF control of a TFT provided for a pixel.

The FPCs 3*a* and 3*b* are located to correspond to the respective source driver ICs 6*a* and 6*b*. At the above-mentioned locations, the FPCs 3*a* and 3*b* connect the display panel P1 and the circuit board 2.

The circuit board 2 includes an interface connector 7. Electronic parts (not illustrated), such as a capacitor, are implemented on the circuit board 2. An external unit (an external device) is connected to the interface connector 7. The circuit board 2 receives various signals (e.g., an image signal) from the external unit through the interface connector 7. The circuit board 2 transmits the received signals to the source driver ICs 6*a* and 6*b* through the FPCs 3*a* and 3*b*.

The circuit board 2 also outputs signals transmitted from the source driver ICs 6*a* and 6*b* to the external unit through the interface connector 7.

The number of source driver ICs, the number of FPCs, and the number of gate driver ICs are not limited to those illustrated in FIG. 1. For example, the number of source driver ICs may be four. A single FPC may connect the circuit board and a source driver IC. The number of gate driver ICs may be two.

Figure 2:
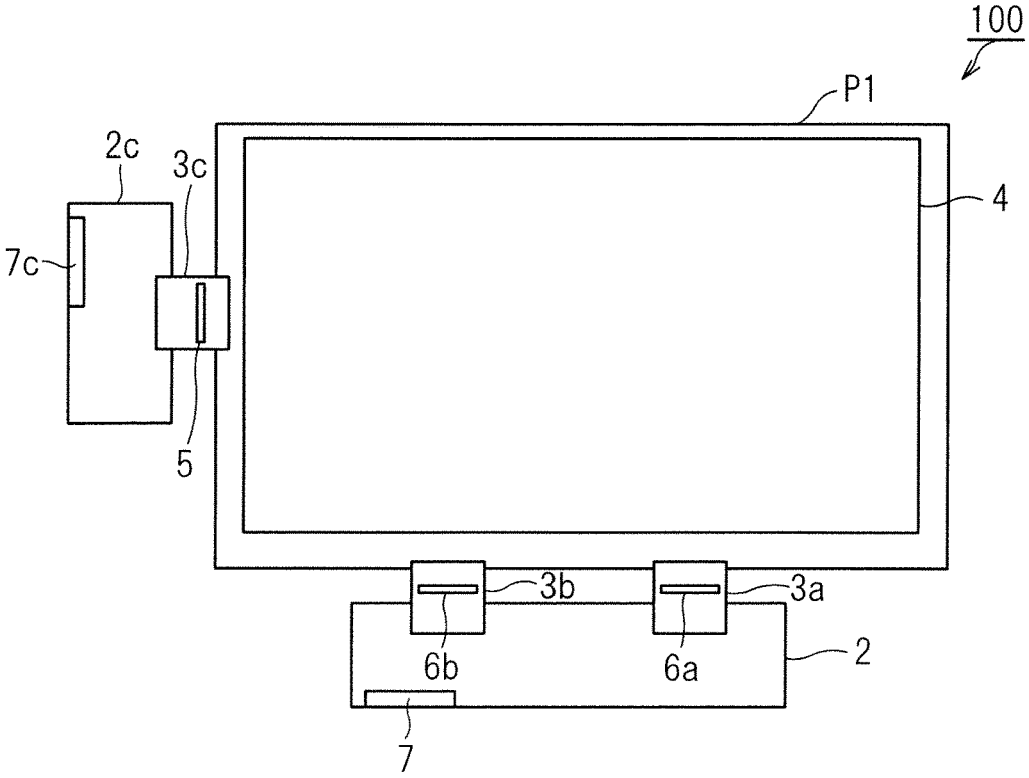
FIG. 2 schematically illustrates another configuration of the display device according to Embodiment 1.

A source driver IC or a gate driver IC may be disposed on an FPC. As illustrated in FIG. 2, for example, the source driver IC 6*a* may be disposed on the FPC 3*a*. The source driver IC 6*b* may similarly be disposed on the FPC 3*b*.

As illustrated in FIG. 2, the display device 100 may further include an FPC 3*c* and a circuit board 2*c*. In this case, the gate driver IC 5 may be disposed on the FPC 3*c*. The FPC 3*c* is connected, for example, to the circuit board 2*c*. An interface connector 7*c* to connect an external unit (an external device) may be provided to the circuit board 2*c*.

Figure 3:
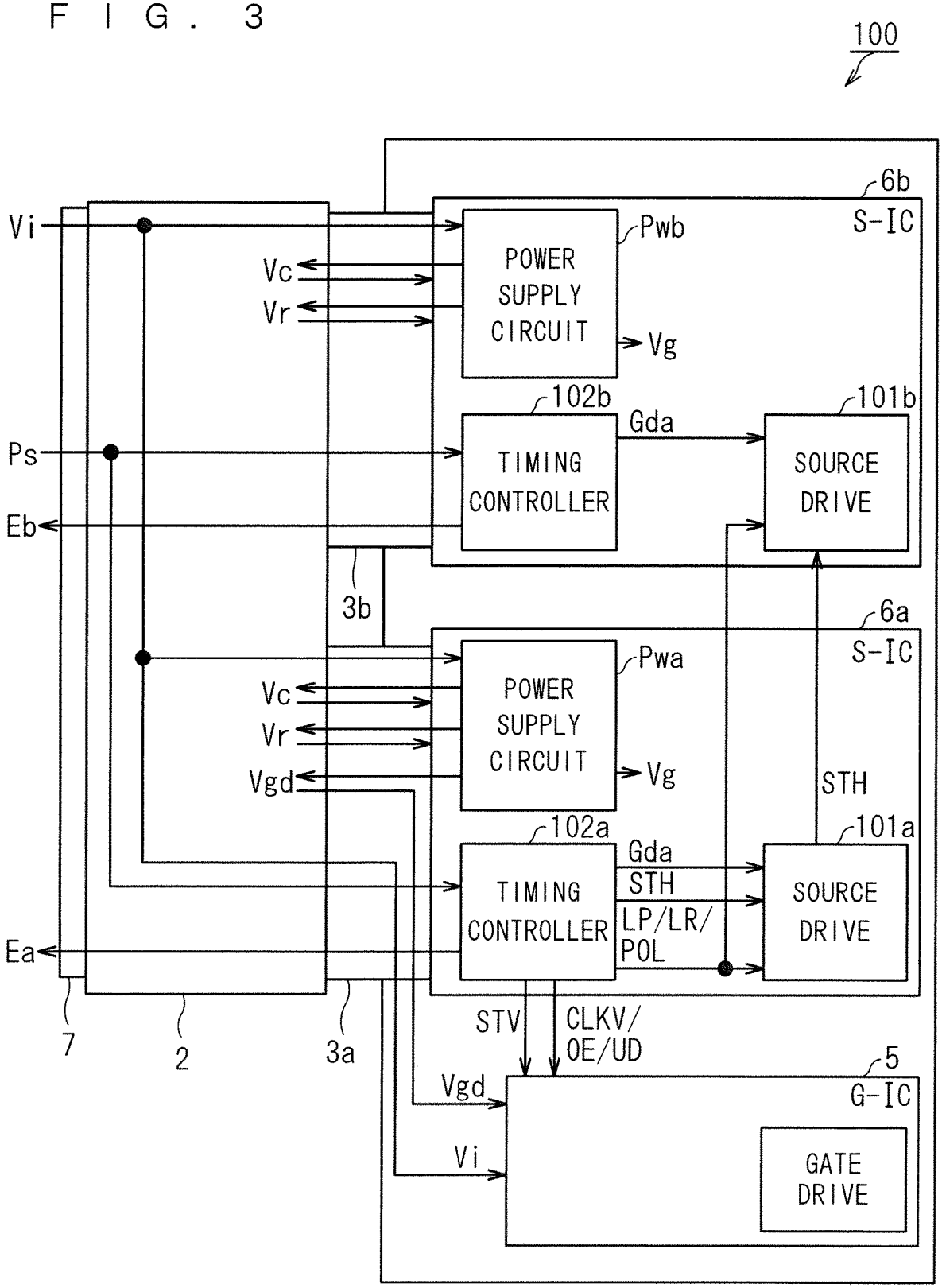
FIG. 3 schematically shows a circuit configuration of the display device according to Embodiment 1.

FIG. 3 schematically shows a circuit configuration of the display device 100 according to Embodiment 1. Referring to FIG. 3, the source driver IC 6*a* includes a power supply circuit Pwa, a source drive 101*a*, and a timing controller 102*a*. The source driver IC 6*b* includes a power supply circuit Pwb, a source drive 101*b*, and a timing controller 102*b*.

Each of the power supply circuits Pwa and Pwb supplies a voltage to be used in the source driver IC 6*a* and/or the source driver IC 6*b*. Each of the power supply circuits Pwa and Pwb supplies a common voltage Vc, an analog reference voltage Vr, and a tone voltage Vg.

The common voltage Vc is used as a voltage of a counter electrode (not illustrated) included in the display panel P1. The analog reference voltage Vr is a voltage to be used by each of the source drives 101*a* and 101*b* as an analog reference voltage.

The number of types of the analog reference voltage Vr shown in FIG. 3 is one, but is not limited to one. The number of types of the analog reference voltage Vr may be two. In this case, the power supply circuit (e.g., the power supply circuit Pwa) may supply analog reference voltages Vr of a positive electrode and a negative electrode, for example.

The common voltage Vc supplied by the power supply circuit (e.g., the power supply circuit Pwa) is supplied to the source driver IC (e.g., the source driver IC 6*a*) through the circuit board 2. The analog reference voltage Vr supplied by the power supply circuit (e.g., the power supply circuit Pwa) is supplied to the source driver IC (e.g., the source driver IC 6*a*) through the circuit board 2.

The tone voltage Vg is a voltage to be referenced when D/A conversion is performed on image data. The tone voltage Vg has a plurality of voltage levels.

The power supply circuit Pwa also supplies a gate drive voltage Vgd. The gate drive voltage Vgd is a voltage for the gate driver IC 5. The gate drive voltage Vgd is represented by a positive voltage and a negative voltage. The positive voltage is a voltage indicating a high level when the TFT of the pixel is in an ON state. The negative voltage is a voltage indicating a low level when the TFT of the pixel is in an OFF state. The gate drive voltage Vgd is supplied to the gate driver IC 5 through the circuit board 2.

FIG. 3 shows a configuration in which the power supply circuit is present only in each of the source driver ICs 6*a* and 6*b*, but the configuration is not limited to this configuration. For example, a part necessary for generation of voltages to be used in a coil, a capacitor, and the like may be provided to the circuit board 2.

A power supply circuit to supply the gate drive voltage Vgd to the gate driver IC 5 is the power supply circuit Pwa of the source driver IC 6*a* in FIG. 3, but is not limited to the power supply circuit Pwa. The power supply circuit Pwb of the source driver IC 6*b* may supply the gate drive voltage Vgd to the gate driver IC 5. The gate drive voltage Vgd may be supplied to the gate driver IC 5 through the circuit board 2 and another FPC.

The source driver ICs 6*a* and 6*b* receive the same image signal Ps. That is to say, the timing controllers 102*a* and 102*b* receive the same image signal Ps.

The timing controller 102*a* transmits image data Gda, which will be described below, based on the image signal Ps to the source drive 101*a*. The timing controller 102*b* transmits the image data Gda, which will be described below, based on the image signal Ps to the source drive 101*b*.

The timing controller 102*a* transmits a horizontal start pulse STH to the source drive 101*a*. The source drive 101*a* transmits the received horizontal start pulse STH to the source drive 101*b*.

In the present embodiment, the source driver IC 6*a* operates as a master. The source driver IC 6*b* operates as a slave. The source driver IC 6*a* as the master thus transmits a vertical start pulse STV to the gate driver IC 5. Specifically, the timing controller 102*a* transmits the vertical start pulse STV to the gate driver IC 5.

The timing controller 102*a* also transmits a shift clock signal CLKV, an output control signal OE (Output Enable), and a scan switching logic signal UD to the gate driver IC 5. The scan switching logic signal UD is used for switching to scan in a vertical direction.

The timing controller 102*a* also transmits a horizontal scan switching logic signal LR, a liquid crystal application polarity switching signal POL, and a control signal LP to the source drives 101*a* and 101*b*. The control signal LP is a signal to control an internal latch and an output timing of a source driver function.

The circuit configuration of the display device 100 is not limited to the circuit configuration shown in FIG. 3. For example, the number of source driver ICs, the number of FPCs, the number of gate driver ICs, and the like are not limited to those shown in FIG. 3. For example, the number of source driver ICs included in the display device 100 may be three or more.

Figure 4:
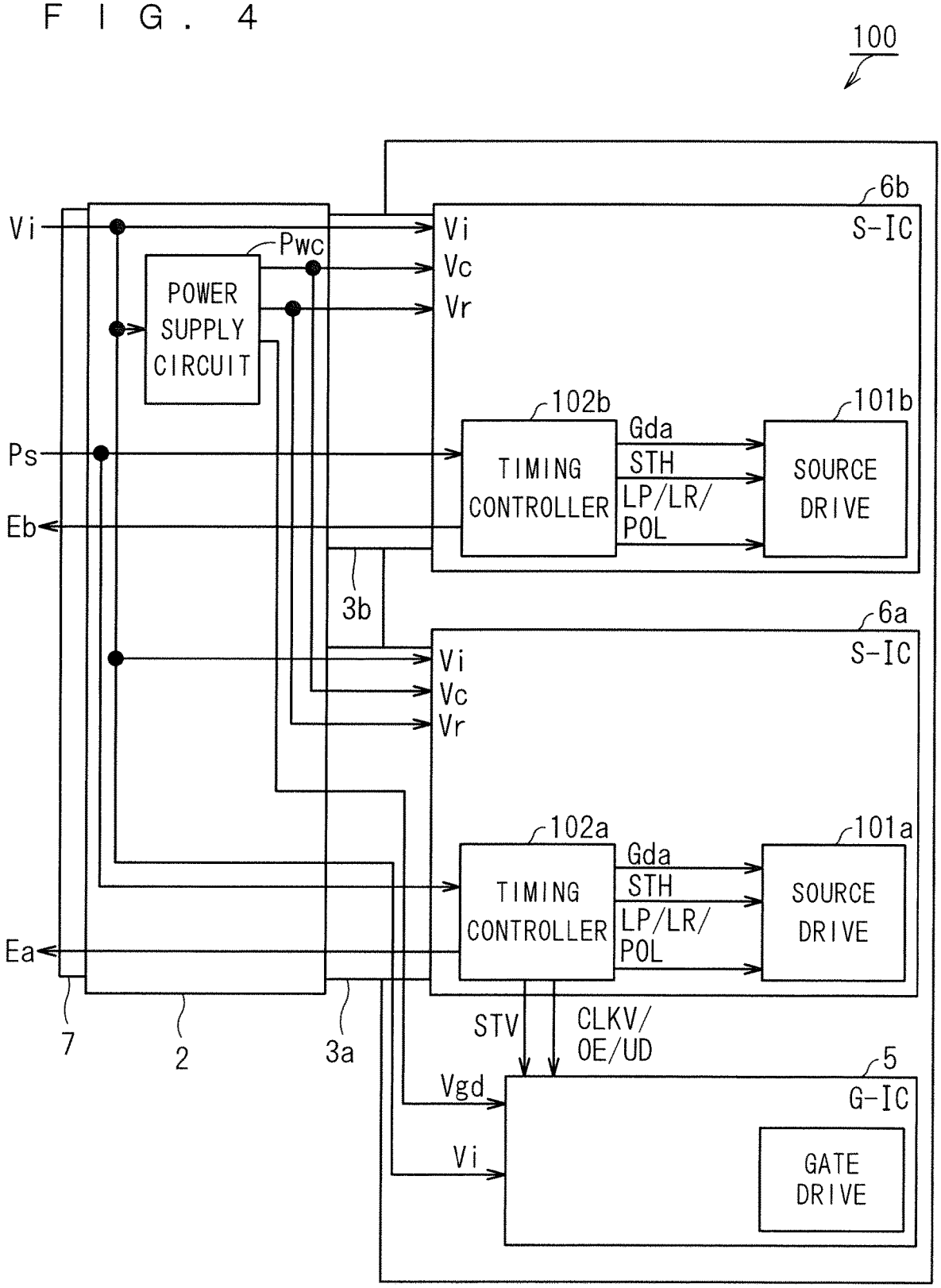
FIG. 4 shows a configuration of a display device to which a modified configuration m1 has been applied.

A configuration (hereinafter, also referred to as a "modified configuration m1") in which the power supply circuit is provided to the circuit board 2 may be applied, for example. FIG. 4 shows a configuration of the display device 100 to which the modified configuration m1 has been applied. In the modified configuration m1, a power supply circuit Pwc is provided to the circuit board 2. The power supply circuit Pwc supplies the common voltage Vc and the analog reference voltage Vr to the source driver ICs 6*a* and 6*b*. In the modified configuration m1, the power supply circuit Pwc supplies the gate drive voltage Vgd to the gate driver IC 5.

In the modified configuration m1, the timing controller 102*a* transmits the horizontal start pulse STH to the source drive 101*a*. The timing controller 102*b* transmits the horizontal start pulse STH to the source drive 101*b*.

Each of the timing controllers 102*a* and 102*b* has a function to detect various anomalies in the display device 100. The anomalies include, for example, an anomaly of a voltage supplied by the power supply circuit. The anomalies include, for example, an anomaly of operation of the source drive 101*a*, the source drive 101*b*, the gate driver IC 5, and the like. When an anomaly is detected, the timing controllers 102*a* and 102*b* respectively output anomaly signals Ea and Eb.

The anomaly signals Ea and Eb may be converted into a single signal by a circuit provided to the circuit board 2, and the single signal may be output from the interface connector 7.

Each of the source driver ICs 6*a* and 6*b* is an image adjustment element having an image adjustment function. Specifically, each of the timing controllers 102*a* and 102*b* has the image adjustment function. Each of the source driver ICs 6*a* and 6*b* performs an image adjustment process. Specifically, each of the timing controllers 102*a* and 102*b* performs the image adjustment process. The image adjustment process is an image process of adjusting image data included in the image signal Ps, although details will be described below.

An image indicated by the image data will be described next. The display device 100 (the display panel P1) displays an image. The image is composed of a plurality of pixels. The size of the image is hereinafter represented as "u×v pixels". Each of "u" and "v" is a natural number. The number "u" is the number of pixels in a horizontal direction of the image. The number "v" is the number of pixels in the vertical direction of the image.

Red, green, and blue are hereinafter also referred to as "R", "G", and "B", respectively. When the pixel region 4 of the display panel P1 has a size of 1920×1080 pixels, the image is composed of 2,073,600 (1920×1080) pixels.

The color of each of the pixels is represented by R, G, and B colors. Each of the plurality of pixels constituting the image is represented, for each of R, G, and B color components, by eight bits, for example. In this case, each of the pixels is represented by a tone value (digital value) in the range of 0 to 255.

A tone value of the R component of the pixel is hereinafter also referred to as a "tone value Rv". A tone value of the G component of the pixel is hereinafter also referred to as a "tone value Gv". A tone value of the B component of the pixel is hereinafter also referred to as a "tone value By". Each of the plurality of pixels constituting the image is represented by the tone values Rv, Gv, and By. The pixel may be represented by the R, G, and B colors and a W (white) color.

The image data included in the image signal Ps is hereinafter also referred to as "image data Gd". The image indicated by the image data Gd is hereinafter also referred to as an "image G1".

Figure 5:
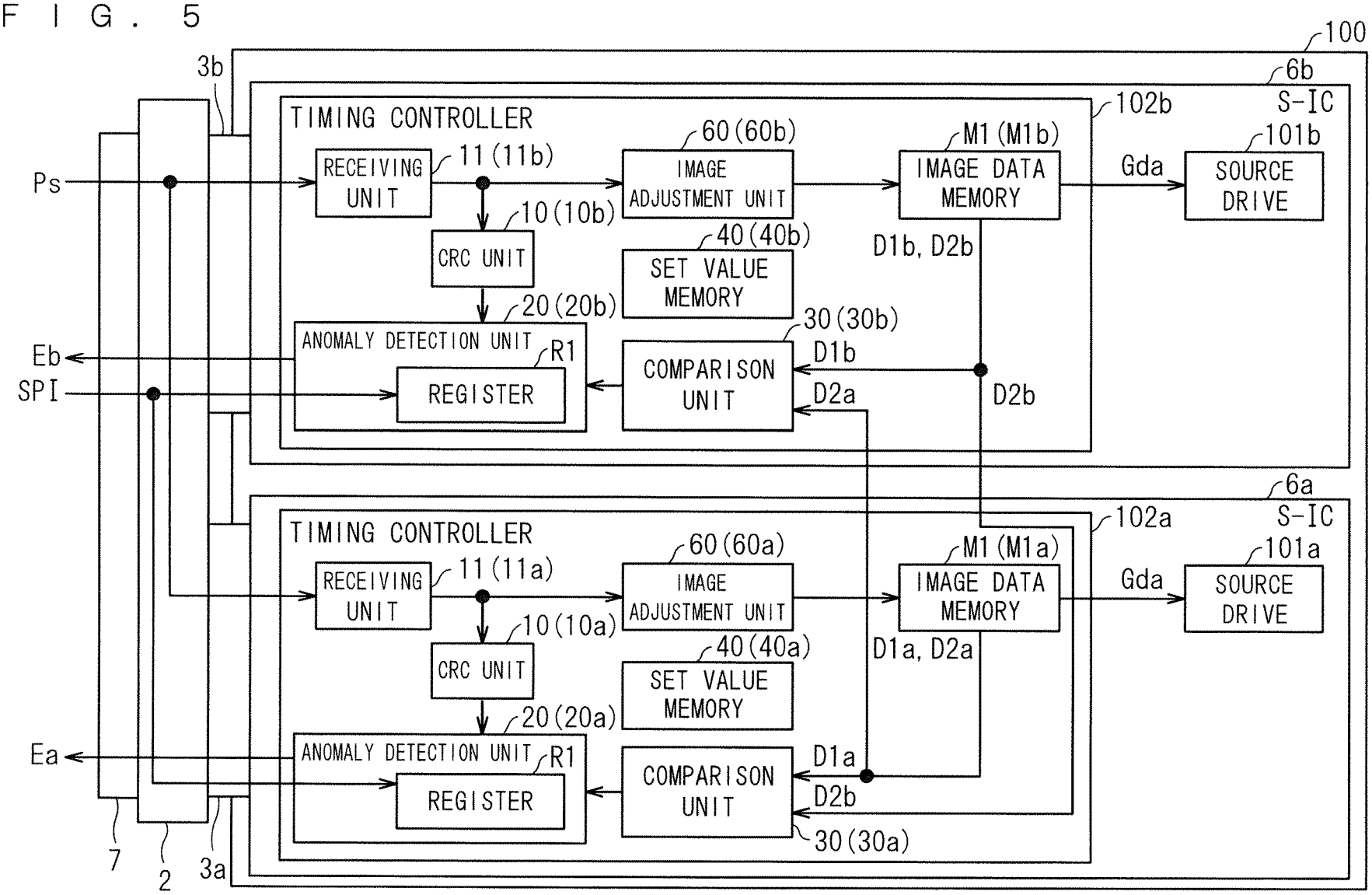
FIG. 5 shows a configuration relating to image adjustment of source driver ICs according to Embodiment 1.

A configuration relating to image adjustment of the source driver ICs 6*a* and 6*b* will be described next. FIG. 5 shows the configuration relating to image adjustment of the source driver ICs 6*a* and 6*b* according to Embodiment 1. FIG. 5 mainly shows a configuration of the timing controllers 102*a* and 102*b*. The timing controller 102*a* will be described first.

Referring to FIG. 5, the timing controller 102*a* includes a receiving unit 11, an image adjustment unit 60, image data memory M1, set value memory 40, a comparison unit 30, an anomaly detection unit 20, and a CRC unit 10.

The image data memory M1 is first-in first-out (FIFO) memory. That is to say, the image data memory M1 is memory to sequentially output pieces of image data in an order in which the pieces of image data are stored in the image data memory M1.

The anomaly detection unit 20 includes a register R1. The register R1 is a register to store information (e.g., a numerical value). The register R1 is configured to be accessible by the external device from outside the display device 100. For example, SPI communication is used for access to the register R1.

The receiving unit 11 receives the image signal Ps. The receiving unit 11 transmits the image signal Ps to the CRC unit 10 and the image adjustment unit 60.

The image signal Ps might become an unintended image signal due to the occurrence of noise, breaks in the FPCs 3*a* and 3*b*, and the like. In this case, the display device 100 displays an unintended image.

To suppress the problem, a method of using the CRC is known. The method is used in the above-mentioned related configuration A.

Processes described below are performed in the CRC. First, a transmitting device and a receiving device determine a polynomial A in advance. The transmitting device calculates a value C obtained by dividing transmit data B by the polynomial A. The transmitting device adds the value C to the transmit data B, and transmits the transmit data B to the receiving device.

When the transmit data is originally composed of eight bits, and the polynomial A is composed of five bits, for example, the value C is composed of four bits. The 0th to 3rd bits of the transmitted data thus indicate a value of the remainder obtained through division. The 4th to 11th bits of the transmitted data indicate the original transmit data.

Assume herein that the receiving device has received 12 bits of data. In this case, the receiving device checks whether the remainder obtained by dividing the 12 bits of data by the polynomial A matches a number composed of the 0th to 3rd bits of the received data. When they match, the receiving device judges that the data has normally been received. In this case, the receiving device uses the 4th to 11th bits of the received data as the image data.

The CRC unit 10 of each of the timing controllers 102*a* and 102*b* performs the CRC on the received image signal Ps. Each of the timing controllers 102*a* and 102*b* can thereby check whether the image data included in the received image signal Ps is normal (intended) image data.

The image adjustment unit 60 performs the image adjustment process. The image adjustment process includes a contrast adjustment process, a brightness adjustment process, and a gamma adjustment process.

Figure 6:
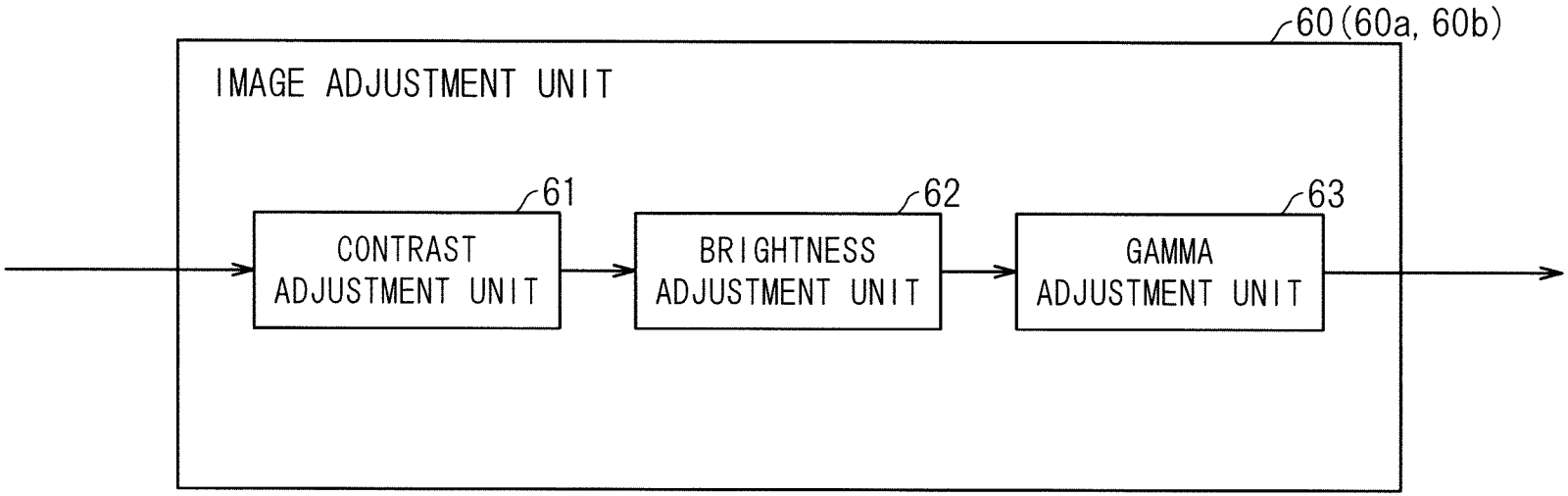
FIG. 6 shows a configuration of an image adjustment unit according to Embodiment 1.

FIG. 6 shows a configuration of the image adjustment unit 60 according to Embodiment 1. The image adjustment unit 60 includes a contrast adjustment unit 61, a brightness adjustment unit 62, and a gamma adjustment unit 63. Processes performed by the components of the image adjustment unit 60 will be described below.

Referring back to FIG. 5, various parameter values to be used in the image adjustment process are stored in the set value memory 40. The set value memory 40 is non-volatile memory or volatile memory.

The timing controller 102*a* has the same configuration as the timing controller 102*b*. To distinguish between the components of the timing controller 102*a* and the components of the timing controller 102*b*, reference signs are defined as described below.

First, a symbol "a" is added to the end of a reference sign of each of the components of the timing controller 102*a* to define the reference sign of each of the components of the timing controller 102*a*. For example, the receiving unit 11 of the timing controller 102*a* is identified by a reference sign "11*a*", which is obtained by adding the symbol "a" to the end of the reference sign "11" of the receiving unit 11.

The timing controller 102*a* thus includes a receiving unit 11*a*, an image adjustment unit 60*a*, image data memory M1*a*, set value memory 40*a*, a comparison unit 30*a*, an anomaly detection unit 20*a*, and a CRC unit 10*a* as shown in FIG. 5.

A symbol "b" is similarly added to the end of a reference sign of each of the components of the timing controller 102*b* to define the reference sign of each of the components of the timing controller 102*b*. The timing controller 102*b* thus includes a receiving unit 11*b*, an image adjustment unit 60*b*, image data memory M1*b*, set value memory 40*b*, a comparison unit 30*b*, an anomaly detection unit 20*b*, and a CRC unit 10*b* as shown in FIG. 5.

The image adjustment process performed by the timing controller 102*a* (the image adjustment unit 60) will be described next. The image adjustment process is performed on the image data Gd included in the image signal Ps. That is to say, the image adjustment process is performed on the image G1 indicated by the image data Gd.

In the image adjustment process, the contrast adjustment unit 61 performs the contrast adjustment process. The contrast adjustment process is a typical image process of adjusting contrast of the image. In the contrast adjustment process, contrast between a bright portion and a dark portion of the image is adjusted.

The contrast adjustment process to enhance contrast is a process of making the bright portion brighter and the dark portion darker. The contrast adjustment process to reduce contrast is a process of making the bright portion darker and the dark portion brighter.

Assume that input data is represented by 255 levels of tone, and an intermediate value is 127, for example. In this case, data is set, for example, by an equation "output data=127+(input data−127)×(any scale factor)". Intensity of contrast of the image can be adjusted by setting the intermediate value, the scale factor, and the like.

The scale factor is set to one or more to enhance contrast of the image. An adjustment amount thereby increases as a value becomes away from the intermediate value. Contrast between the bright portion and the dark portion of the image is thus enhanced.

In the contrast adjustment process, a parameter value stored in the set value memory 40 is used. The parameter value is, for example, the above-mentioned scale factor.

Next, the brightness adjustment unit 62 performs the brightness adjustment process. The brightness adjustment process is a typical image process of adjusting brightness of the image. In the brightness adjustment process, output data is adjusted, for example, by an equation "output data=input data+any adjustment value", for example. Brightness of the output data is adjusted by adding the adjustment value to the input data or by subtracting the adjustment value from the input data.

In the brightness adjustment process, a parameter value stored in the set value memory 40 is used. The parameter value is, for example, the above-mentioned adjustment value.

Next, the gamma adjustment unit 63 performs the gamma adjustment process. The gamma adjustment process is a typical image process of making gamma adjustment on the image. In the gamma adjustment process, the input data (the image data) is adjusted so that developed color intensity of an image displayed by the display device 100 is proportional to a value of the input data.

Figure 7:
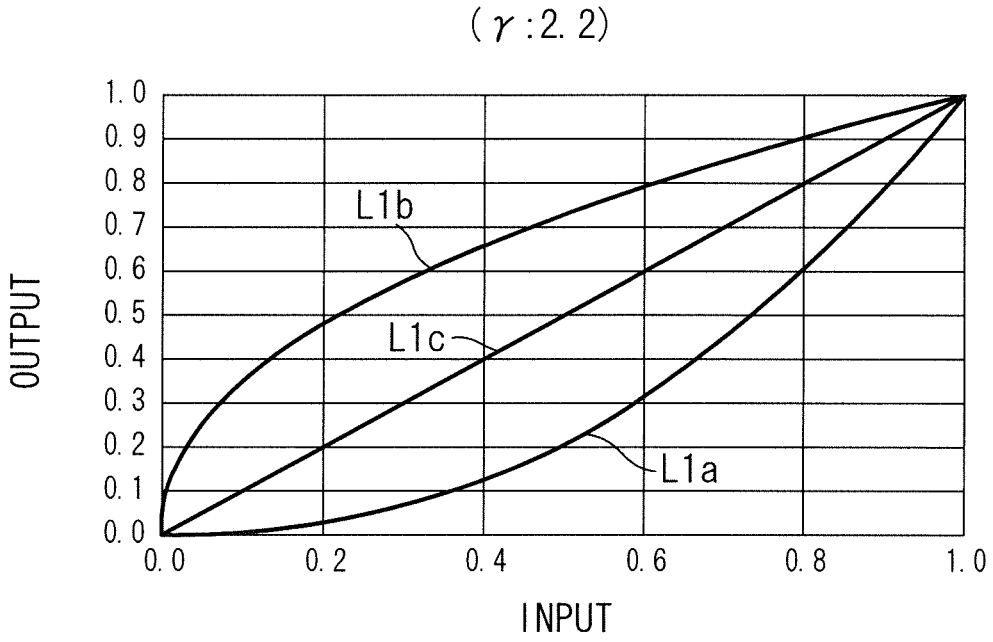
FIG. 7 is a diagram for explaining a gamma adjustment process.

The gamma adjustment process will be described with use of FIG. 7. The horizontal axis in FIG. 7 represents the value of the input data of the image signal. The vertical axis in FIG. 7 represents a value of the output data or the developed color intensity after gamma adjustment. As shown by a characteristic line L1*a* in FIG. 7, the input data and the developed color intensity are typically not proportional to each other in the liquid crystal display.

In the gamma adjustment process, an equation "$Y=X\gamma$" is used. X, Y, and γ respectively represent the input data, the image data, and a gamma adjustment value. In the gamma adjustment process, adjustment is made so that the gamma adjustment value in the above-mentioned equation is 2.2.

In the gamma adjustment process, the gamma adjustment unit 63 adjusts the input data using the gamma adjustment value (1/2.2), and outputs data after adjustment (see a characteristic line L1*b* in FIG. 7). As a result, the input data and the developed color intensity have a proportional relationship (see a characteristic line L1*c* in FIG. 7).

Figure 8:
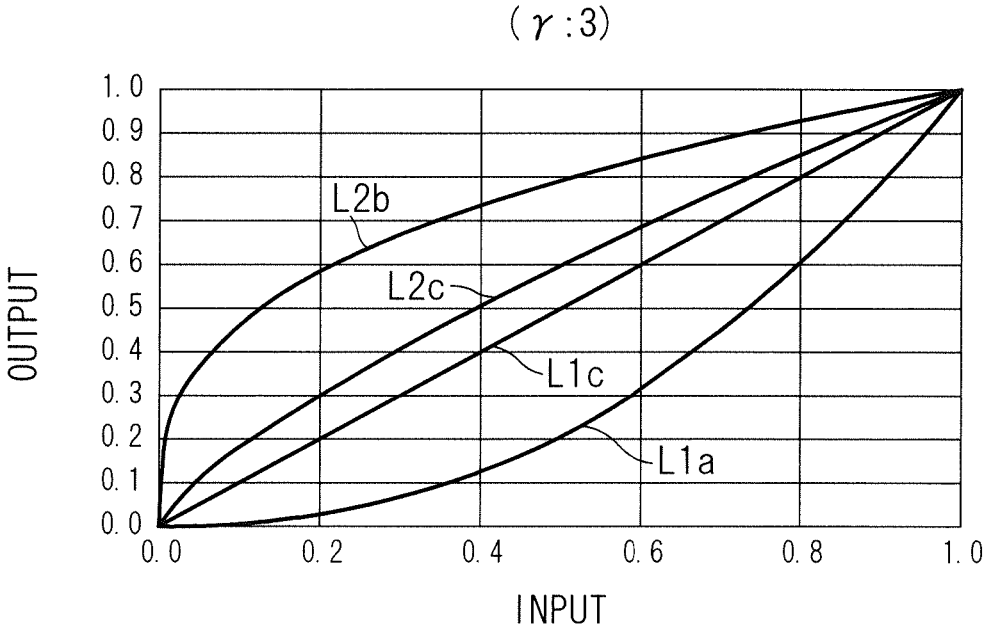
FIG. 8 is a diagram for explaining the gamma adjustment process.

FIG. 8 shows a characteristic line when the gamma adjustment value is ⅓. When the gamma adjustment value is ⅓, the developed color has slightly higher intensity (see a characteristic line L2*c* in FIG. 8) compared with the result when the gamma adjustment value is 2.2 (see the characteristic line L1*c* in FIG. 8). The displayed image as a whole can thereby be made brighter.

In the gamma adjustment process, a parameter value stored in the set value memory 40 is used. The parameter value is, for example, the above-mentioned gamma adjustment value.

The above-mentioned image adjustment process is performed on the image data Gd included in the image signal Ps. That is to say, the image adjustment process is performed on the image G1 indicated by the image data Gd. Thus, for example, the contrast adjustment process, the brightness adjustment process, and the gamma adjustment process are performed on the image data Gd (the image G1).

The image adjustment process performed by the timing controller 102*b* (the image adjustment unit 60) is similar to the above-mentioned image adjustment process performed by the image adjustment unit 60 of the timing controller 102*a*.

The image G1 changed by the image adjustment process performed on the image data Gd (the image G1) is hereinafter also referred to as an "image G1*a*". Data indicating the image G1*a* is hereinafter also referred to as the "image data Gda".

The image data Gda is the image data after adjustment (hereinafter, also referred to as "adjusted image data") obtained by performing the image adjustment process. That is to say, the adjusted image data is data obtained by performing the image adjustment process on the image data Gd to be processed.

The source driver IC 6*a* (the image adjustment unit 60*a*) performs the image adjustment process on the image data Gd to be processed to obtain the adjusted image data. The source driver IC 6*b* (the image adjustment unit 60*b*) performs the image adjustment process on the image data Gd to be processed to obtain the adjusted image data.

The process of adjusting the image using the gamma adjustment value is described above. On the other hand, a process of setting any output data to the input data may be performed. In the process, the output data is set to 0 when the input data is 0, for example. In the process, the output data is set to 2 when the input data is 1, for example. This allows for finer image adjustment.

Details of the contrast adjustment process, the brightness adjustment process, and the gamma adjustment process may be those other than the above-mentioned details. Furthermore, only some of the contrast adjustment process, the brightness adjustment process, and the gamma adjustment process may be performed in the image adjustment process. For example, only the contrast adjustment process and the brightness adjustment process may be performed in the image adjustment process.

The processes performed in the image adjustment process are not limited to the contrast adjustment process, the brightness adjustment process, and the gamma adjustment process. An image process other than the contrast adjustment process, the brightness adjustment process, and the gamma adjustment process may be performed in the image adjustment process. The contrast adjustment process, the brightness adjustment process, and the gamma adjustment process may be performed in the image adjustment process in an order different from the above-mentioned order.

The image adjustment unit 60 performs the image adjustment process to obtain the image data Gda as the adjusted image data. The image adjustment unit 60 stores the obtained image data Gda in the image data memory M1. The image data Gda stored in the image data memory M1 is transmitted to the source drive 101*a* and the comparison unit 30.

As described above, the timing controller 102*a* (the image adjustment unit 60) performs the image adjustment process on the image data Gd included in the image signal Ps. The image data Gd included in the image signal Ps is thus different from the image data Gda as the adjusted image data.

As described above, the various parameter values to be used in the image adjustment process are stored in the set value memory 40. Thus, if a situation as described below arises, unintended image adjustment is made to cause the image displayed by the display device 100 to be an unintended image.

The situation is, for example, a situation in which false data is stored when a parameter value is stored in the set value memory 40. The situation is, for example, a situation in which the parameter value changes due to the influence of noise, and the like. The situation is, for example, a situation in which the image adjustment unit 60 of the timing controller 102*a* does not normally operate due to a failure of the image adjustment unit 60.

As described above, it is necessary to check whether intended adjusted image data (the image data Gda) has been obtained in the display device 100 to perform the image adjustment process. A process (hereinafter also referred to as an "anomaly detection process") to detect an anomaly in a situation in which the image adjustment process is performed will be described.

Figure 9:
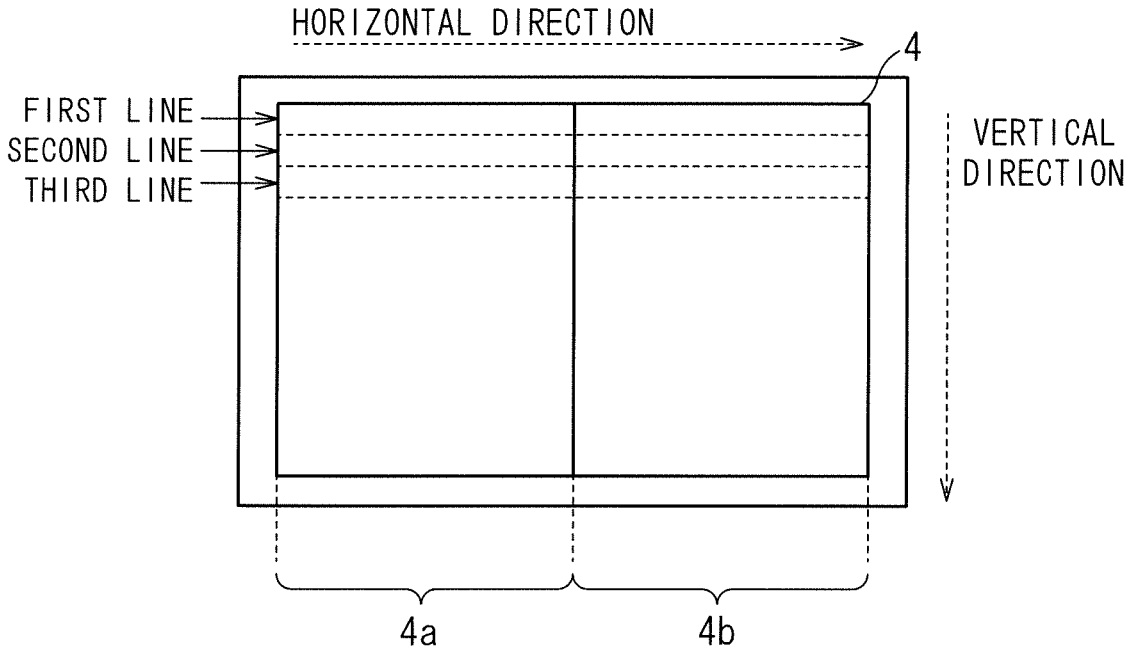
FIG. 9 illustrates a pixel region to display images.

Control of the source driver ICs 6*a* and 6*b* will be described herein. FIG. 9 illustrates the pixel region 4 to display images. The pixel region 4 has a size of 1920×1080 pixels, for example. The pixel region 4 includes regions 4*a* and 4*b*. The region 4*a* is a region to be controlled by the source driver IC 6*a* (the source drive 101*a*). The region 4*b* is a region to be controlled by the source driver IC 6*b* (the source drive 101*b*).

Each of the source driver ICs 6*a* and 6*b* controls a source voltage. Specifically, each of the source drives 101*a* and 101*b* controls the source voltage. That is to say, each of the source drives 101*a* and 101*b* is a source control unit.

The source voltage is a voltage for the display device 100 to display an image based on the above-mentioned adjusted image data. A plurality of source lines (not illustrated) are provided in the pixel region 4. Specifically, the source voltage is a voltage applied to each of the source lines.

The color of each of the pixels is herein represented by the R, G, and B colors. Each of the source drives 101*a* and 101*b* thus controls the source voltage applied to each of 2880 source lines (not illustrated). The value 2880 is calculated by an equation "1920×3÷2".

The source driver IC 6*a* (the source drive 101*a*) controls the region 4*a* by the above-mentioned method. That is to say, the source drive 101*a* performs control (control of the source voltage) to display the left half of the image. The source driver IC 6*b* (the source drive 101*b*) controls the region 4*b* by the above-mentioned method. That is to say, the source drive 101*b* performs control (control of the source voltage) to display the right half of the image.

Figure 10:
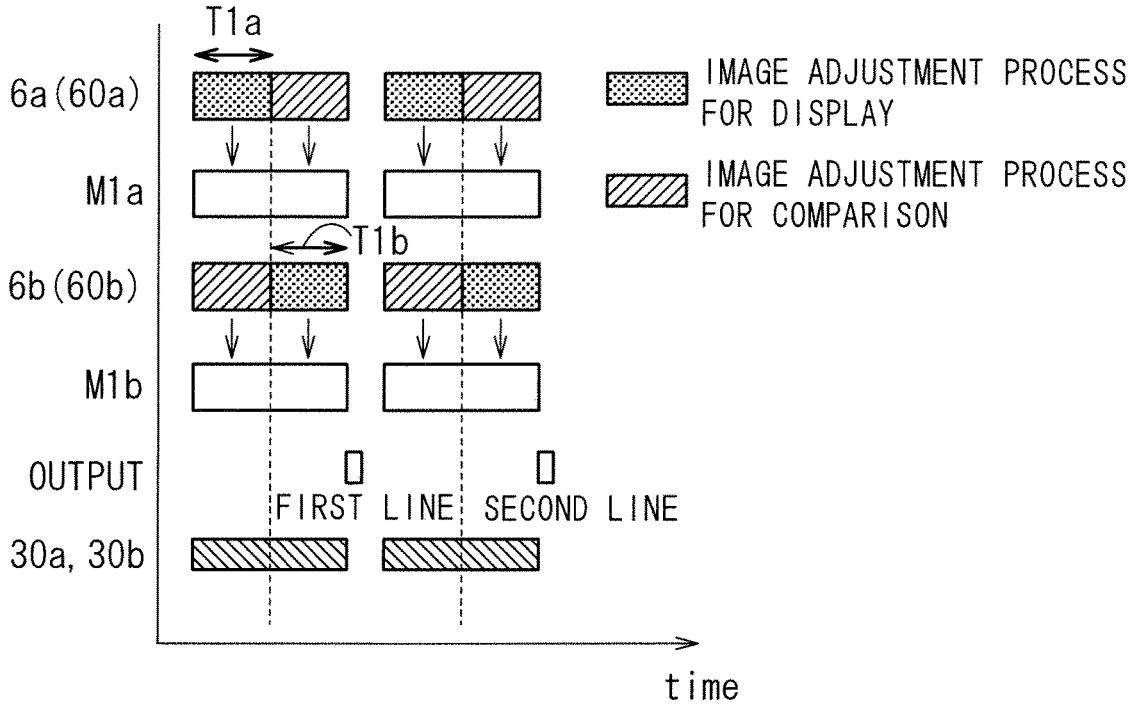
FIG. 10 is a timing diagram for explaining a comparison process according to Embodiment 1.

The anomaly detection process will be described next with use of FIG. 10. Reference signs of components are shown along the vertical axis in FIG. 10. In FIG. 10, "OUTPUT" corresponds to output (control) of the source driver IC. The horizontal axis in FIG. 10 represents time. The above-mentioned image adjustment process performed by the image adjustment unit 60 for display is hereinafter also referred to as an "image adjustment process for display". The above-mentioned image adjustment process performed by the image adjustment unit 60 for comparison is hereinafter also referred to as an "image adjustment process for comparison".

The image adjustment process for display or the image adjustment process for comparison is performed, for example, on one line of the image data Gd. Lines of the image data Gd on each of which the image adjustment process for display or the image adjustment process for comparison is performed are input not simultaneously but sequentially.

A target on which the image adjustment process for display or the image adjustment process for comparison is performed is not limited to one line of the image data Gd. The target on which the image adjustment process for display or the image adjustment process for comparison is performed may, for example, be all the lines of the image data Gd.

In the present embodiment, after the source driver IC 6*a* (the image adjustment unit 60*a*) performs the image adjustment process for display, the source driver IC 6*b* (the image adjustment unit 60*b*) performs the image adjustment process for display, for example.

The image adjustment unit 60*a* performs the image adjustment process for display to obtain adjusted image data (hereinafter, also referred to as "adjusted image data D1*a*"). That is to say, the source driver IC 6*a* (the image adjustment unit 60*a*) performs the image adjustment process for display to obtain the adjusted image data D1*a*. This means that the adjusted image data D1*a* is the adjusted image data obtained by the source driver IC 6*a* (the image adjustment unit 60*a*) performing the image adjustment process. The adjusted image data D1*a* is the image data Gda.

The image adjustment unit 60*a* stores the obtained adjusted image data D1*a* in the image data memory M1*a* (see FIGS. 5 and 10). The timing controller 102*a* transmits, to the source drive 101*a*, the adjusted image data D1*a* as the image data Gda stored in the image data memory M1*a*.

The image adjustment unit 60*b* performs the image adjustment process for display to obtain adjusted image data (hereinafter, also referred to as "adjusted image data D1*b*"). That is to say, the source driver IC 6*b* (the image adjustment unit 60*b*) performs the image adjustment process for display to obtain the adjusted image data D1*b*. The adjusted image data D1*b* is the image data Gda.

The image adjustment unit 60*b* stores the obtained adjusted image data D1*b* in the image data memory M1*b* (see FIGS. 5 and 10). The timing controller 102*b* transmits, to the source drive 101*b*, the adjusted image data D1*b* as the image data Gda stored in the image data memory M1*b*.

A time period during which the source driver IC 6*a* (the image adjustment unit 60*a*) performs the image adjustment process for display is hereinafter also referred to as a "time period T1*a*" or "T1*a*". A time period during which the source driver IC 6*b* (the image adjustment unit 60*b*) performs the image adjustment process for display is hereinafter also referred to as a "time period T1*b*" or "T1*b*". The time periods T1*a* and T1*b* do not overlap each other. That is to say, the time periods T1*a* and T1*b* do not overlap each other on a time axis.

In the time period T1*a*, the source driver IC 6*b* (the image adjustment unit 60*b*) performs the image adjustment process for comparison to obtain adjusted image data. The adjusted image data is image data to be used by the source driver IC 6*a* (the image adjustment unit 60*a*) in a comparison process A, which will be described below.

The image adjustment unit 60*b* performs the image adjustment process for comparison to obtain the adjusted image data (hereinafter, also referred to as "adjusted image data D2*b*"). That is to say, the adjusted image data D2*b* is adjusted image data obtained by the source driver IC 6*b* (the image adjustment unit 60*b*) performing the image adjustment process for comparison. The adjusted image data D2*b* is the image data Gda.

The adjusted image data D2*b* is the same as the adjusted image data D1*b*. The adjusted image data D1*b* and the adjusted image data D2*b* bear different reference signs because they are transmitted to different destinations.

The image adjustment unit 60*b* stores the obtained adjusted image data D2*b* in the image data memory M1*b* (see FIGS. 5 and 10). The source driver IC 6*b* transmits, to the comparison unit 30*a* of the source driver IC 6*a*, the adjusted image data D2*b* stored in the image data memory M1*b*. The source driver IC 6*a* (the comparison unit 30*a*) thereby obtains the adjusted image data D2*b* from the source driver IC 6*b*.

In the time period T1*b*, the source driver IC 6*a* (the image adjustment unit 60*a*) performs the image adjustment process for comparison to obtain adjusted image data. The adjusted image data is image data to be used by the source driver IC 6*b* (the image adjustment unit 60*b*) in the comparison process A, which will be described below.

The image adjustment unit 60*a* performs the image adjustment process for comparison to obtain the adjusted image data (hereinafter, also referred to as "adjusted image data D2*a*"). The adjusted image data D2*a* is the image data Gda.

The adjusted image data D2*a* is the same as the adjusted image data D1*a*. The adjusted image data D1*a* and the adjusted image data D2*a* bear different reference signs because they are transmitted to different destinations.

The image adjustment unit 60*a* stores the obtained adjusted image data D2*a* in the image data memory M1*a* (see FIGS. 5 and 10). The source driver IC 6*a* transmits, to the comparison unit 30*b* of the source driver IC 6*b*, the adjusted image data D2*a* stored in the image data memory M1*a*. The source driver IC 6*b* (the comparison unit 30*b*) thereby obtains the adjusted image data D2*a* from the source driver IC 6*a*.

To transmit and receive the pieces of the adjusted image data between the source driver ICs 6*a* and 6*b*, bidirectional or unidirectional signals are used, for example. Serial or parallel signals may be used to transmit and receive the pieces of the adjusted image data. Error correction, such as the CRC, may be performed to suppress the influence of noise.

The source driver ICs 6*a* and 6*b* (the image adjustment units 60*a* and 60*b*) perform the image adjustment processes on the same image data Gd included in the image signal Ps using the same parameter value. Thus, when the parameter value is normal, and the image adjustment processes are normally performed, the pieces of the adjusted image data D1*a*, D1*b*, D2*a*, and D2*b* are the same.

Each of the source driver ICs 6*a* and 6*b* performs the comparison process A. Specifically, each of the comparison units 30*a* and 30*b* performs the comparison process A.

The comparison unit 30*a* of the source driver IC 6*a* performs the comparison process A of comparing the pieces of the adjusted image data D1*a* and D2*b*. Each of the pieces of the adjusted image data D1*a* and D2*b* compared in the comparison process A is data obtained by performing the same image adjustment process on the same image data Gd.

Pieces of the adjusted image data are sequentially stored in each of the image data memory M1*a* and the image data memory M1*b*. The comparison unit 30*a* thus sequentially performs the comparison process A in an order in which the pieces of the adjusted image data are stored in the image data memory M1*a*.

When the result of the comparison process A indicates that the pieces of the adjusted image data D1*a* and D2*b* do not match, the display device 100 (the comparison unit 30*a*) determines that an anomaly is occurring in the display device 100. That is to say, the comparison unit 30*a* detects the anomaly. In this case, the comparison unit 30*a* transmits anomaly occurrence notification to the anomaly detection unit 20*a*. The anomaly occurrence notification is notification that an anomaly is occurring in the display device 100.

When it is determined that the anomaly is occurring, the display device 100 outputs an anomaly signal. Specifically, when the anomaly detection unit 20*a* has received the anomaly occurrence notification, the anomaly detection unit 20*a* outputs the anomaly signal Ea (see FIG. 5). When the anomaly detection unit 20*a* has received the anomaly occurrence notification, the anomaly detection unit 20*a* (the display device 100) stores "1" in the register R1. "1" is information indicating that an anomaly is occurring. In the register R1 in an initial state, "0" is stored. "0" is information indicating that no anomaly is occurring.

As described above, the register R1 is configured to be accessible by the external device (not illustrated) from outside the display device 100. For example, the SPI communication is used for access to the register R1. Whether an anomaly is occurring can thereby be judged based on a value stored in the register R1.

A communication means other than the SPI communication may be used for access to the register R1. A value of the image data when an anomaly is detected, the number of times an anomaly is detected, and the like may be stored in the register R1. The occurrence of an anomaly can be detected with a configuration in which the anomaly signal is used and a configuration in which the register R1 is used. The display device 100 may have only one of the above-mentioned two configurations.

In the source driver IC 6*b*, processes similar to the above-mentioned processes performed in the source driver IC 6*a* are performed. The processes performed in the source driver IC 6*b* will briefly be described below. For example, the comparison unit 30*b* of the source driver IC 6*b* performs the comparison process A of comparing the pieces of the adjusted image data D1*b* and D2*a*.

When the result of the comparison process A indicates that the pieces of the adjusted image data D1*b* and D2*a* do not match, the comparison unit 30*b* determines that an anomaly is occurring in the display device 100.

When it is determined that the anomaly is occurring, the anomaly detection unit 20*b* outputs the anomaly signal Eb. When it is determined that the anomaly is occurring, the anomaly detection unit 20*b* also stores "1" in the register R1. The processes performed in the source driver IC 6*b* are as described above.

The display device 100 repeatedly performs the above-mentioned comparison process A. That is to say, each of the source driver ICs 6*a* and 6*b* repeatedly performs the comparison process A. Specifically, the comparison process A is repeatedly performed on pieces of the adjusted image data corresponding to all the lines from the first line to the last line of the image data.

As described above, according to the present embodiment, the display device 100 performs the comparison process A of comparing first adjusted image data and second adjusted image data. The first adjusted image data is adjusted image data obtained by the source driver IC 6*a* performing the image adjustment process on the image data to be processed. The second adjusted image data is adjusted image data obtained by the source driver IC 6*b* performing the image adjustment process on the image data to be processed.

When the image adjustment process is normally performed by both the source driver ICs 6*a* and 6*b*, the first adjusted image data and the second adjusted image data match. On the other hand, when the image adjustment process is not normally performed by the source driver IC 6*a* and/or the source driver IC 6*b*, the first adjusted image data and the second adjusted image data do not match.

The display device 100 can thus detect the image adjustment process having not normally been performed by performing the comparison process A. That is to say, an anomaly of the adjusted image data (the image data after image adjustment) as the result of image adjustment can be detected.

In the related configuration A, a display device checks that there is no anomaly in received image data though the CRC and the like. In the related configuration A, however, when the display device performs the image adjustment process on the image data, and an anomaly occurs in the image data after adjustment due to a malfunction A described below, the anomaly cannot be detected. The image adjustment process includes the above-mentioned contrast adjustment process, brightness adjustment process, gamma adjustment process, and the like.

The malfunction A is, for example, an error of settings. The malfunction A is, for example, an anomaly of the parameter values to be used in the image adjustment process due to the influence of noise and the like. The malfunction A is, for example, a failure of a circuit in the display device.

The display device or a system including the display device thus cannot detect an anomaly of a displayed image to cause a problem in that false information can be provided to a user.

To address the problem, the display device 100 in the present embodiment has the configuration to produce the above-mentioned effect. The display device 100 in the present embodiment can thus solve each of the above-mentioned problems.

<Modification 1>

The present modification is applied to Embodiment 1. In Embodiment 1, it is determined that an anomaly is occurring when the result indicating that two pieces of the adjusted image data do not match is yielded once as the result of the comparison process A, but the configuration is not limited to this configuration. The result indicating that the two pieces of the adjusted image data do not match as the result of the comparison process A is hereinafter also referred to as a "mismatch result".

In the present modification, it is determined that an anomaly is occurring when the mismatch result is yielded a plurality of times. Specifically, when the comparison process A is repeatedly performed to yield the result indicating that two pieces of the adjusted image data to be compared do not match a plurality of times, the display device 100 (the comparison unit 30) determines that an anomaly is occurring in the display device 100.

Assume that the comparison unit 30*a* of the source driver IC 6*a* has repeatedly performed the comparison process A, for example. In this case, when the mismatch result indicating that the pieces of the adjusted image data D1*a* and D2*b* do not match is yielded a predetermined number of times as the result of the comparison process A, the comparison unit 30*a* determines that an anomaly is occurring in the display device 100. The predetermined number of times is two or more times, for example.

The comparison unit 30*a* may determine that an anomaly is occurring in the display device 100 when the mismatch result is yielded a plurality of times in a time period during which the pieces of data corresponding to all the lines from the first line to the last line of the image data are output, for example. When it is determined that an anomaly is occurring, the display device 100 (the anomaly detection unit 20*a*) may output the anomaly signal Ea, for example.

<Modification 2>

The present modification is applied to all or one of Embodiment 1 and Modification 1. In Embodiment 1, pieces of the adjusted image data (the image data) as a whole are to be compared. This configuration has a problem of an increase in power consumption of the source driver IC, heat generation of the source driver IC, and the like, for example.

To address the problem, parts of the pieces of the adjusted image data (the image data) are to be compared in the present modification. For example, the comparison unit 30*a* of the source driver IC 6*a* performs the comparison process A of comparing a part of the adjusted image data D1*a* and a part of the adjusted image data D2*b*.

Figure 11:
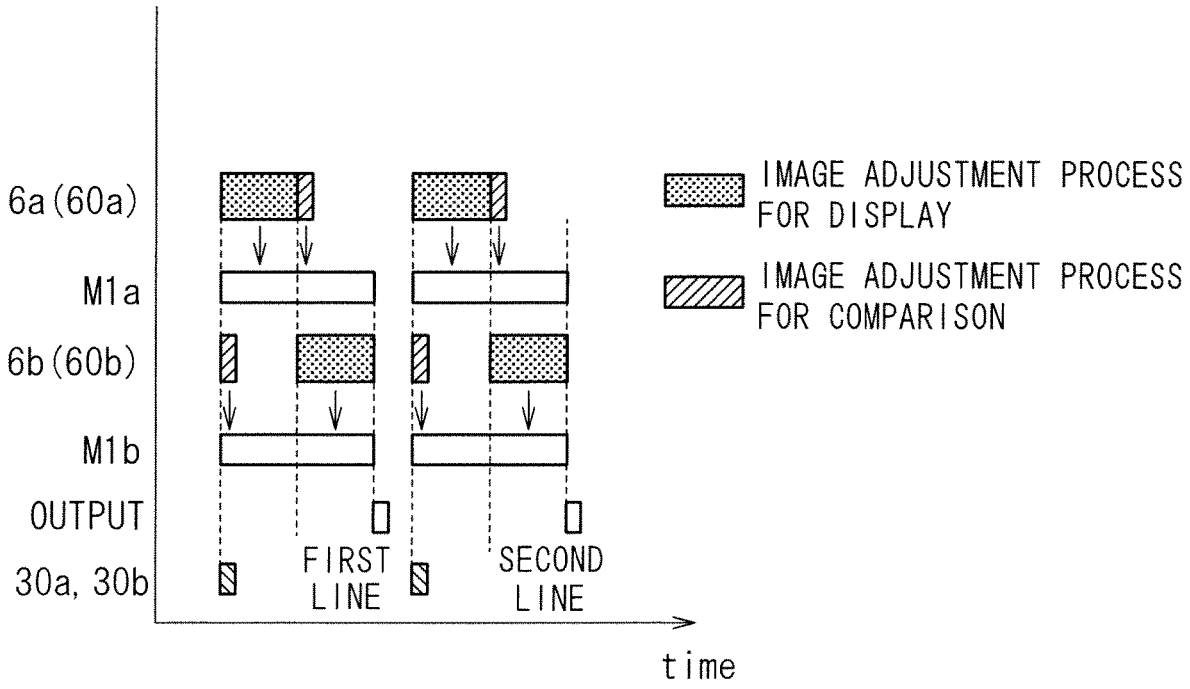
FIG. 11 is a timing diagram for explaining a comparison process according to Modification 2.

FIG. 11 shows one example of a timing diagram in the present modification. Reference signs of the components in FIG. 11 are similar to those in FIG. 10, so that description thereof is omitted.

In the present modification, parts of pieces of the adjusted image data corresponding to a pixel at the head of each line are to be compared, for example. Parts of the pieces of the adjusted image data corresponding to a pixel at the head of each source driver IC is to be compared, for example. Only pieces of the adjusted image data corresponding to the first line from among all the pieces of the adjusted image data corresponding to all the lines of the image data are to be compared, for example.

Assume herein that the display device 100 has a refresh rate of 60 Hz. The refresh rate corresponds to an interval between updates of an image. In this case, an anomaly can be detected within 16.6 msec even by a method of comparing parts of pieces of image data.

<Modification 3>

The present modification is applied to all or some of Embodiment 1, Modification 1, and Modification 2. In the present modification, the display device 100 performs the comparison process A in a time period during which the display device 100 does not perform the image adjustment process. For example, the source driver ICs 6*a* and 6*b* (the comparison units 30*a* and 30*b*) perform the comparison process A in a time period during which each of the source driver ICs 6*a* and 6*b* does not perform the image adjustment process.

Figure 12:
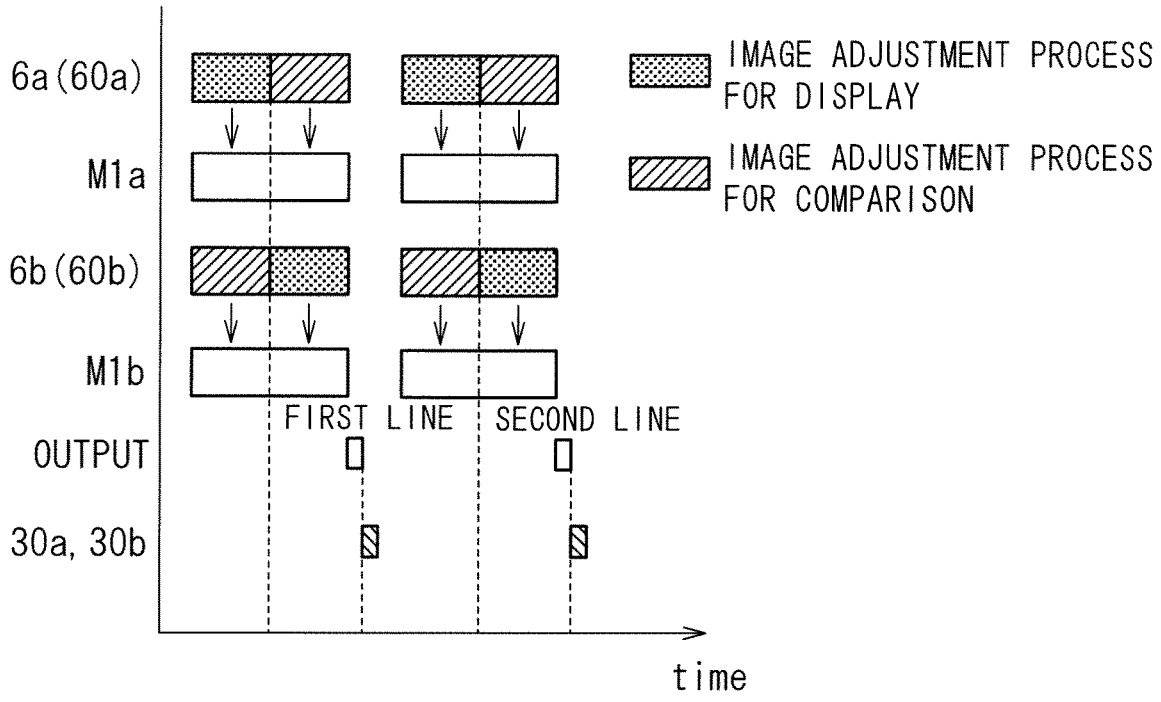
FIG. 12 is a timing diagram for explaining a comparison process according to Modification 3.

FIG. 12 is a timing diagram for explaining the comparison process according to Modification 3. Reference signs of the components in FIG. 12 are similar to those in FIG. 10, so that description thereof is omitted. In the present modification, the comparison process A is performed in a time period between lines, for example. The time period between lines corresponds to a time period between two processes corresponding to respective two lines.

As described above, the display device 100 (the comparison unit 30) performs the comparison process A in the time period during which the display device 100 does not perform the image adjustment process. Reduction in power consumption of the display device 100, reduction in heat generation of the display device 100, and the like can thereby be achieved.

When the image data memory M1 is the FIFO memory, pieces of the image data are sequentially output to overwrite the output data. The pieces of the image data thus cannot be compared at any timing in some cases.

Figure 13:
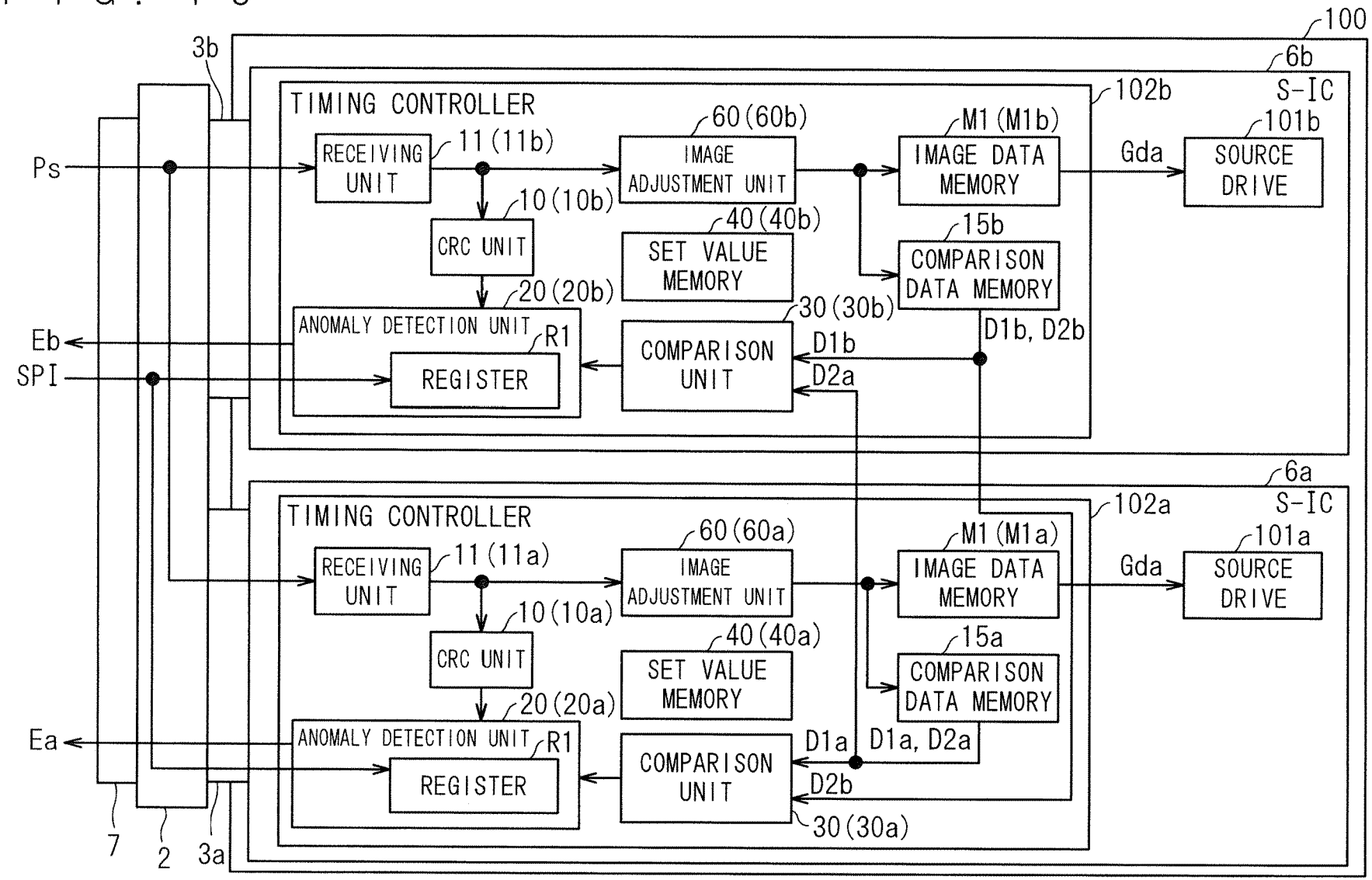
FIG. 13 shows a configuration of a display device according to Modification 3.

In the present modification, comparison data memory may be included in addition to the image data memory M1. FIG. 13 shows a configuration of the display device 100 according to Modification 3. The configuration in FIG. 13 is, for example, the configuration of the display device 100 in FIG. 5 in Embodiment 1 to which Modification 3 has been applied.

Referring to FIG. 13, the source driver IC 6*a* further includes comparison data memory 15*a* in the present modification. The source driver IC 6*b* further includes comparison data memory 15*b*.

The pieces of the adjusted image data D1*a* and D2*a* to be used in the comparison process A are stored in the comparison data memory 15*a*. The pieces of the adjusted image data D1*b* and D2*b* to be used in the comparison process A are stored in the comparison data memory 15*b*.

The comparison process A can thereby be performed at any timing in the time period during which the image adjustment process is not performed. The comparison process A can be performed, for example, in a time period between horizontal lines as the time period during which the image adjustment process is not performed.

<Modification 4>

The present modification is applied to all or some of Embodiment 1, Modification 1, Modification 2, and Modification 3. In the present modification, comparison between parameter values is performed in the comparison process A in addition to comparison between pieces of the image data.

Figure 14:
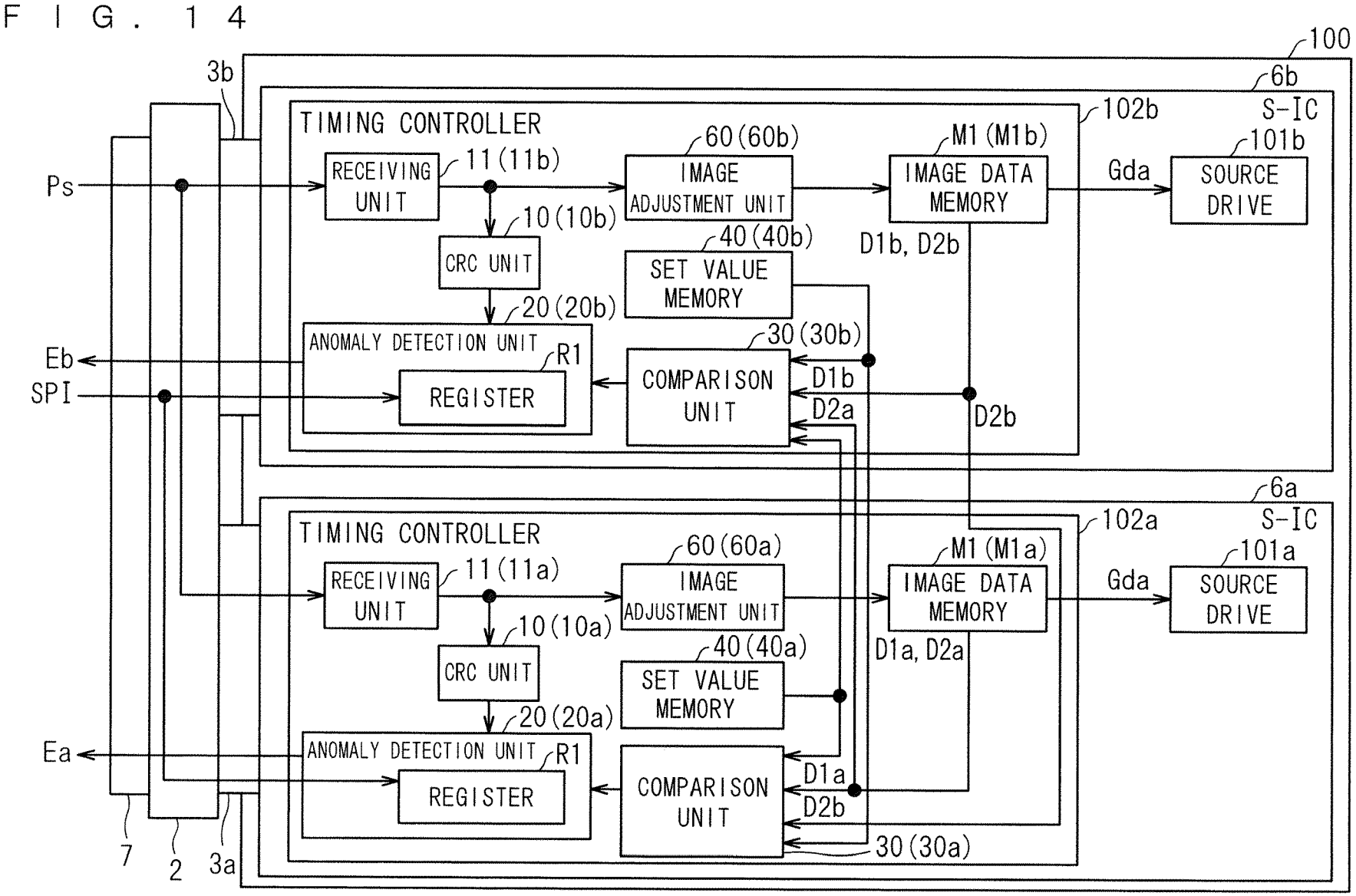
FIG. 14 shows a configuration of a display device according to Modification 4.

FIG. 14 shows a configuration of the display device 100 according to Modification 4. The configuration in FIG. 14 is, for example, the configuration of the display device 100 in FIG. 5 in Embodiment 1 to which Modification 4 has been applied.

A parameter value to be used by the source driver IC 6*a* (the image adjustment unit 60*a*) to perform the image adjustment process is hereinafter also referred to as a "first parameter value". The first parameter value is stored in the set value memory 40*a*. A parameter value to be used by the source driver IC 6*b* (the image adjustment unit 60*b*) to perform the image adjustment process is hereinafter also referred to as a "second parameter value". The second parameter value is stored in the set value memory 40*b*.

A process of comparing the first parameter value and the second parameter value is hereinafter also referred to as a "comparison process P". The comparison process A in the present modification includes the comparison process P.

Thus, in the present modification, the display device 100 performs the comparison process A including the comparison process P of comparing the first parameter value and the second parameter value. The comparison process A in the present modification includes the process of comparing two pieces of the adjusted image data and the comparison process P. The process of comparing two pieces of the adjusted image data is similar to that in Embodiment 1.

In the present modification, the comparison process A (the comparison process P) is performed by the source driver IC 6*a* and/or the source driver IC 6*b*. Specifically, the comparison process A (the comparison process P) is performed by the comparison unit 30*a* and/or the comparison unit 30*b*.

For example, the comparison unit 30*a* performs the comparison process P of comparing the first parameter value and the second parameter value. When the result of the comparison process P indicates that the first parameter value and the second parameter value do not match, the display device 100 (the comparison unit 30*a*) determines that an anomaly is occurring in the display device 100.

A parameter value (a set value) stored in non-volatile memory is typically copied into volatile memory to perform the comparison process P. In the comparison process P, parameter values in both of the non-volatile memory and the volatile memory may be compared.

<Modification 5>

The present modification is applied to all or some of Embodiment 1, Modification 1, Modification 2, Modification 3, and Modification 4. In the present modification, the comparison process A is performed using a data register, which will be described below, included in the source drive.

Each of the source drives 101*a* and 101*b* has a function to perform D/A conversion. For example, the source drive 101*a* performs D/A conversion on a digital value indicated by the image data Gda (the adjusted image data) received from the timing controller 102*a*, although details thereof will be described below.

Figure 15:
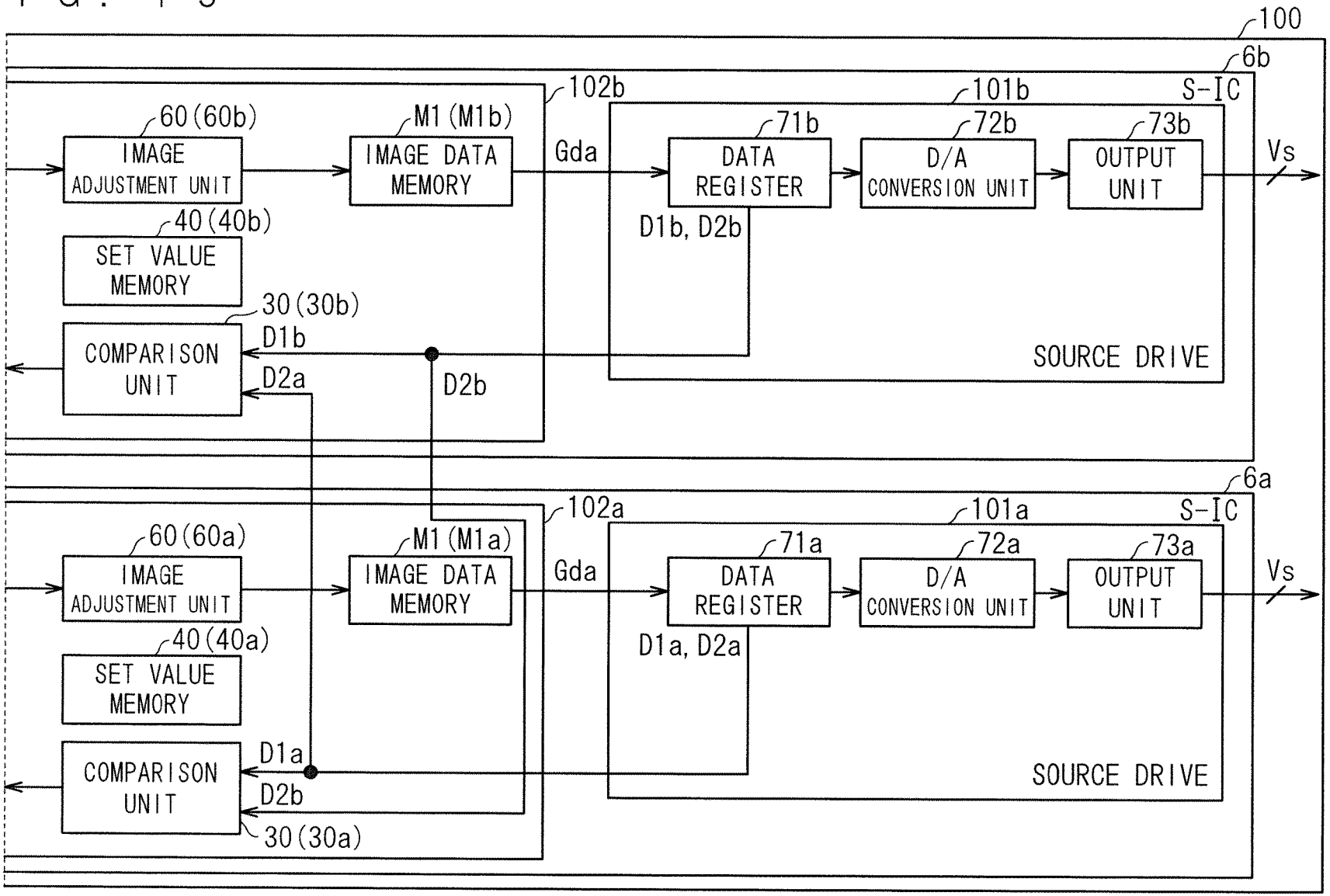
FIG. 15 shows a configuration of a portion of a display device according to Modification 5.

FIG. 15 shows a configuration of a portion of the display device 100 according to Modification 5. FIG. 15 shows a main configuration of the display device 100 according to Modification 5.

In the present modification, the source drive 101*a* includes a data register 71*a*, a D/A conversion unit 72*a*, and an output unit 73*a*.

The output unit 73*a* outputs the source voltage. As described above, the source voltage is the voltage for the display device 100 to display the image based on the above-mentioned adjusted image data. The source voltage is hereinafter also referred to as a "source voltage Vs" or "Vs".

The source drive 101*b* includes a data register 71*b*, a D/A conversion unit 72*b*, and an output unit 73*b*. The data register 71*b*, the D/A conversion unit 72*b*, and the output unit 73*b* respectively perform processes similar to processes performed by the data register 71*a*, the D/A conversion unit 72*a*, and the output unit 73*a*.

As processes performed in the present modification, processes performed in the source drive 101*a* will be mainly described next. In the present modification, the timing controller 102*a* transmits, to the source drive 101*a*, the above-mentioned pieces of the adjusted image data D1*a* and D2*a* as the image data Gda. The pieces of the adjusted image data D1*a* and D2*a* are those described in Embodiment 1.

The source drive 101*a* stores the image data Gda (the pieces of the adjusted image data D1*a* and D2*a*) received from the timing controller 102*a* in the data register 71*a*. The image data Gda (the pieces of the adjusted image data D1*a* and D2*a*) stored in the data register 71*a* is in a state in which horizontal scan switching, a liquid crystal application polarity, and the like are considered. The image data Gda (the adjusted image data D1*a*) is transmitted to the D/A conversion unit 72*a*.

Next, the D/A conversion unit 72*a* performs D/A conversion on the digital value indicated by the image data Gda. D/A conversion is a process of converting the digital value to an analog value. The output unit 73*a* outputs the source voltage Vs based on the image data Gda on which D/A conversion has been performed.

The image data Gda not output as the source voltage Vs is stored in the data register 71*a*. For example, the image data Gda output from the source drive 101*b* is stored in the data register 71*a*.

In the present modification, the source drive 101*a* transmits the adjusted image data D2*a* stored in the data register 71*a* to the comparison unit 30*b* of the source driver IC 6*b*. In the source drive 101*b*, processes similar to the above-mentioned processes performed in the source drive 101*a* are performed. The source drive 101*b* thereby transmits the adjusted image data D2*b* stored in the data register 71*b* to the comparison unit 30*a* of the source driver IC 6*a*.

In the present modification, the comparison process A is performed by the source driver IC 6*a* and/or the source driver IC 6*b*. Specifically, the comparison process A is performed by the comparison unit 30*a* and/or the comparison unit 30*b* as in Embodiment 1. The two pieces of the adjusted image data to be compared in the comparison process A indicate digital values on which D/A conversion has not been performed.

Thus, in the present modification, each of the comparison units 30*a* and 30*b* performs the comparison process A using the digital values on which D/A conversion has not been performed. Only one of the comparison units 30*a* and 30*b* may perform the comparison process A.

When the result of the comparison process A is the mismatch result, for example, the display device 100 (the comparison unit 30) determines that an anomaly is occurring in the display device 100. In this case, the display device 100 (the anomaly detection units 20*a* and 20*b*) outputs the anomaly signals Ea and Eb as in Embodiment 1. The anomaly detection units 20*a* and 20*b* store "1" in the register R1 as in Embodiment 1.

Figure 16:
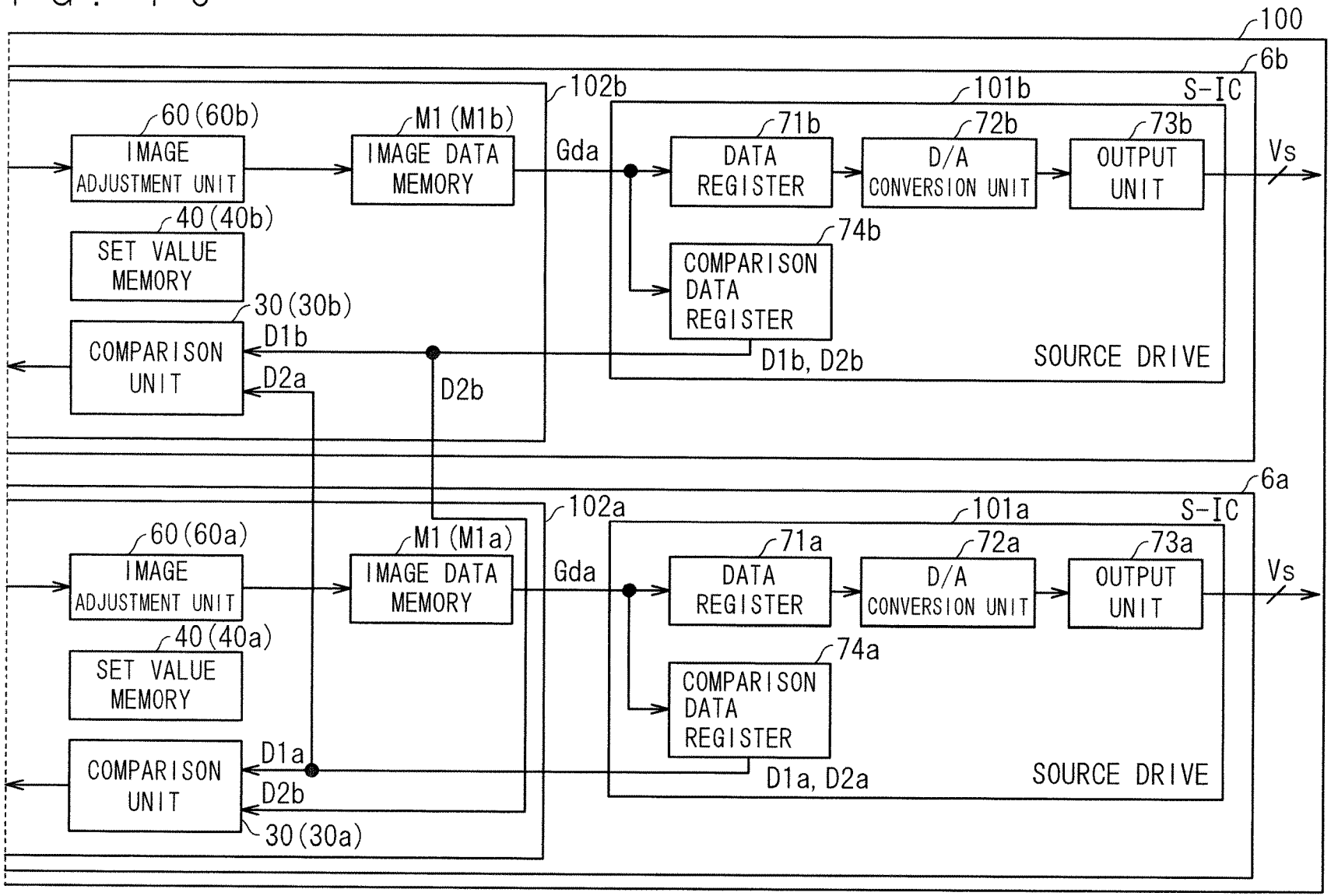
FIG. 16 shows a configuration of a portion of a display device to which a modified configuration m2 has been applied in Modification 5.

In the present modification, a configuration (hereinafter, also referred to as a "modified configuration m2") in which the comparison data memory is included in addition to the image data memory M1 may be applied. FIG. 16 shows a configuration of a portion of the display device 100 to which the modified configuration m2 has been applied in Modification 5. In the modified configuration m2 of the present modification, the source drive 101*a* further includes a comparison data register 74*a*. The source drive 101*b* further includes a comparison data register 74*b*.

In the modified configuration m2 of the present modification, the pieces of the adjusted image data D1*a* and D2*a* to be used in the comparison process A are stored in the comparison data register 74*a*. The pieces of the adjusted image data D1*b* and D2*b* to be used in the comparison process A are stored in the comparison data register 74*b*. The above-mentioned comparison process A is performed in the modified configuration m2 of the present modification.

In the present modification, a configuration (hereinafter, also referred to as a "modified configuration m3") in which the source drive performs the comparison process A may be applied. In the modified configuration m3, the comparison unit is provided not in the timing controller but in the source drive.

Figure 17:
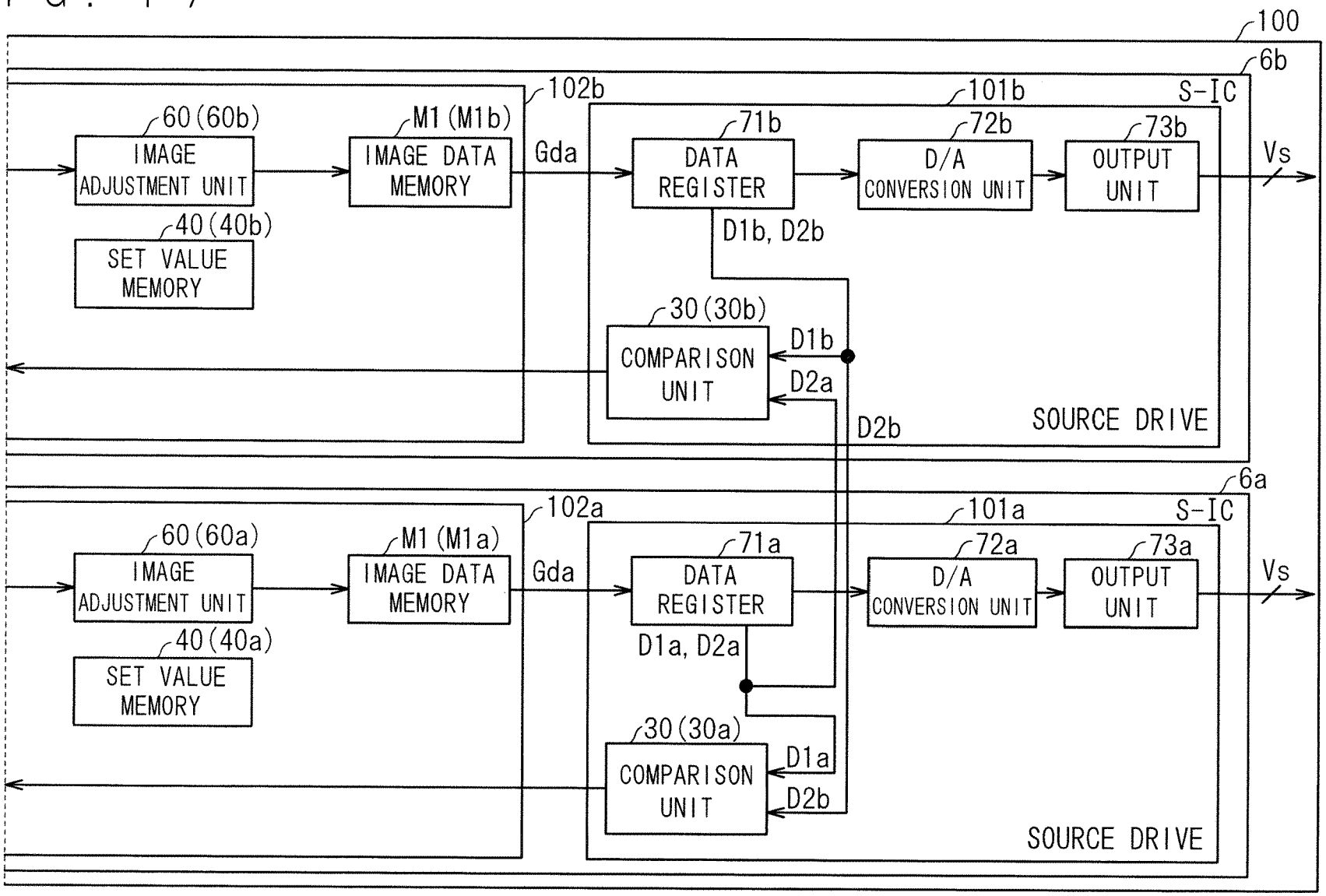
FIG. 17 shows a configuration of a portion of a display device to which a modified configuration m3 has been applied in Modification 5.

FIG. 17 shows a configuration of a portion of the display device 100 to which the modified configuration m3 has been applied in Modification 5. Referring to FIG. 17, in the modified configuration m3, the comparison unit 30*a* is provided not in the timing controller 102*a* but in the source drive 101*a*. In the modified configuration m3, the comparison unit 30*b* is provided not in the timing controller 102*b* but in the source drive 101*b*.

In the modified configuration m3 of the present modification, the source drive 101*a* transmits the adjusted image data D2*a* stored in the data register 71*a* to the comparison unit 30*b* of the source drive 101*b*. In the source drive 101*b*, a process similar to the above-mentioned process performed in the source drive 101*a* is performed. The source drive 101*b* thereby transmits the adjusted image data D2*b* stored in the data register 71*b* to the comparison unit 30*a* of the source drive 101*a*.

In the modified configuration m3, the comparison process A is performed by the source driver IC 6*a* and/or the source driver IC 6*b*. Specifically, the comparison process A is performed by the source drive 101*a* (the comparison unit 30*a*) and/or the source drive 101*b* (the comparison unit 30*b*) as in Embodiment 1. The two pieces of the adjusted image data to be compared in the comparison process A indicate digital values on which D/A conversion has not been performed.

Thus, in the modified configuration m3 of the present modification, each of the source drive 101*a* (the comparison unit 30*a*) and the source drive 101*b* (the comparison unit 30*b*) performs the comparison process A using the digital values on which D/A conversion is not performed. Only one of the comparison units 30*a* and 30*b* may perform the comparison process A.

As described above, according to the present modification, image data (the adjusted image data) before D/A conversion in the source drive is used. The two pieces of the image data (the adjusted image data) in a state in which horizontal scan switching, the liquid crystal application polarity, and the like are considered can thereby be compared.

(Functional Block Diagram)

Figure 18:
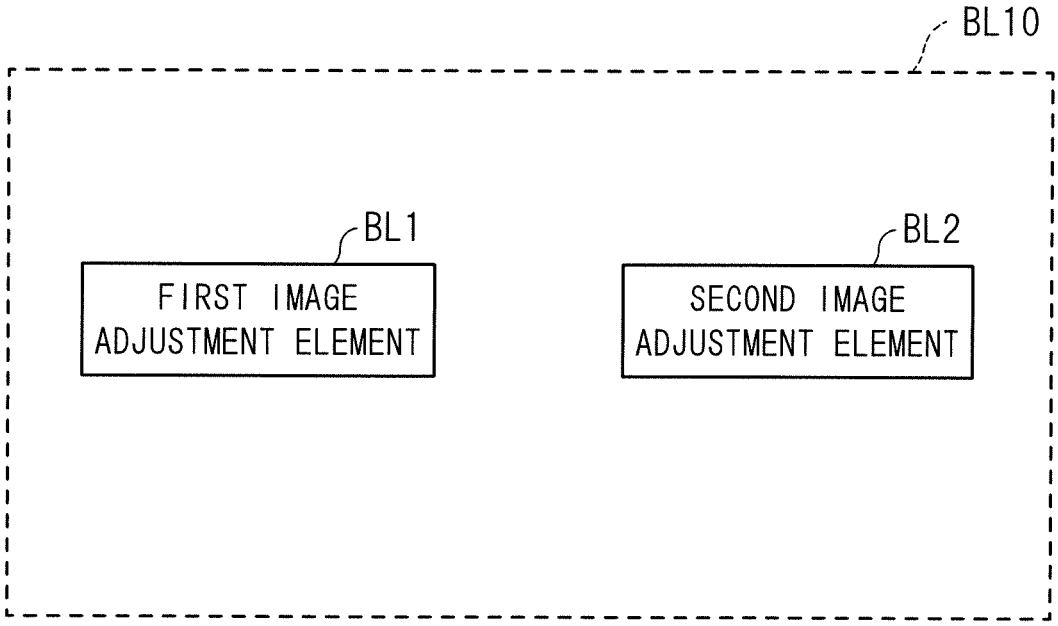
FIG. 18 is a block diagram showing a characteristic functional configuration of the display device.

FIG. 18 is a block diagram showing a characteristic functional configuration of a display device BL10. The display device BL10 corresponds to the display device 100. That is to say, FIG. 18 is a block diagram showing a main function relating to the present technology from among functions of the display device BL10.

The display device BL10 includes a plurality of image adjustment elements to perform an image adjustment process of adjusting image data.

Each of the image adjustment elements performs the image adjustment process on the image data to be processed to obtain adjusted image data as the image data after adjustment.

The plurality of image adjustment elements include a first image adjustment element BL1 and a second image adjustment element BL2. The first image adjustment element BL1 corresponds to the source driver IC 6*a*. The second image adjustment element BL2 corresponds to the source driver IC 6*b*.

The display device BL10 performs a comparison process of comparing the first adjusted image data as the adjusted image data obtained by the first image adjustment element BL1 performing the image adjustment process and the second adjusted image data as the adjusted image data obtained by the second image adjustment element BL2 performing the image adjustment process.

(Other Modifications)

An embodiment and modifications of the present invention can freely be combined with each other, and can be modified or omitted as appropriate within the scope of the invention.

For example, the display device 100 may not include all the components shown in the drawings. That is to say, the display device 100 is required to include only minimum components capable of achieving the effect of the present technology.

The present technology may be achieved as a comparison control method including, as steps, operations of characteristic components of the display device 100. The present technology may be achieved as a program to cause a computer to perform each of the steps included in such a comparison control method. The present technology may be achieved as a computer-readable recording medium storing such a program. The program may be distributed via a transmission medium, such as the Internet.

All the numerical values used in the above-mentioned embodiment or each of the modifications are examples to specifically explain the present technology. That is to say, the present technology is not limited to each of the numerical values used in the above-mentioned embodiment or each of the modifications.

While the invention has been shown and described in detail, the foregoing description is in all aspects illustrative and not restrictive. It is therefore understood that numerous modifications and variations can be devised without departing from the scope of the invention.

What is claimed is:

1. A display device comprising a plurality of image adjustment circuits to perform an image adjustment process of adjusting image data, wherein the plurality of image adjustment circuits include a first image adjustment circuit and a second image adjustment circuit, the first image adjustment circuit performs the image adjustment process on an image data to be processed to obtain a first adjusted image data, the second image adjustment circuit performs the image adjustment process on the image data that is processed by the first image adjustment circuit to obtain a second adjusted image data, the display device performs a comparison process of comparing the first adjusted image data and the second adjusted image data, each of the first image adjustment circuit and the second image adjustment circuit performs the comparison process, in a first time period during which the first image adjustment circuit performs the image adjustment process, the second image adjustment circuit performs the image adjustment process to obtain the second adjusted image data to be used by the first image adjustment circuit in the comparison process, in a second time period during which the second image adjustment circuit performs the image adjustment process, the first image adjustment circuit performs the image adjustment process to obtain the first adjusted image data to be used by the second image adjustment circuit in the comparison process, and the first time period and the second time period do not overlap each other.

2. The display device according to claim 1, wherein each of the first image adjustment circuit and the second image adjustment circuit includes a source controller to control a source voltage as a voltage for the display device to display an image based on the adjusted image data.

3. The display device according to claim 2, wherein the source controller performs D/A conversion on a digital value indicated by the adjusted image data, and the source controller performs the comparison process using the digital value on which the D/A conversion is not performed.

4. The display device according to claim 1, wherein when a result of the comparison process indicates that the first adjusted image data and the second adjusted image data do not match, the display device determines that an anomaly is occurring in the display device.

5. The display device according to claim 4, wherein when it is determined that the anomaly is occurring, the display device outputs an anomaly signal.

6. The display device according to claim 4, further comprising a register to store information, wherein when it is determined that the anomaly is occurring, the display device stores, in the register, information indicating that the anomaly is occurring.

7. The display device according to claim 6, wherein the register is configured to be accessible by an external device from outside the display device.

8. The display device according to claim 1, wherein the display device repeatedly performs the comparison process, and when the comparison process is repeatedly performed to yield a result indicating that the first adjusted image data and the second adjusted image data do not match a plurality of times, the display device determines that an anomaly is occurring in the display device.

9. The display device according to claim 1, wherein the display device performs the comparison process of comparing a part of the first adjusted image data and a part of the second adjusted image data.

10. The display device according to claim 1, wherein the display device performs the comparison process including a process of comparing a first parameter value to be used by the first image adjustment circuit to perform the image adjustment process and a second parameter value to be used by the second image adjustment circuit to perform the image adjustment process.

11. The display device according to claim 1, wherein the first image adjustment circuit performs the image adjustment process to obtain the first adjusted image data, the first image adjustment circuit obtains the second adjusted image data from the second image adjustment circuit, the second image adjustment circuit performs the image adjustment process to obtain the second adjusted image data, and the second image adjustment circuit obtains the first adjusted image data from the first image adjustment circuit.

12. The display device according to claim 1, wherein the display device performs the comparison process in a time period during which the display device does not perform the image adjustment process.

* * * * *